US007760215B2

(12) United States Patent
Inoue et al.

(10) Patent No.: US 7,760,215 B2
(45) Date of Patent: Jul. 20, 2010

(54) LINE HEAD AND AN IMAGE FORMING APPARATUS USING THE LINE HEAD

(75) Inventors: Nozomu Inoue, Matsumoto (JP); Yujiro Nomura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 4 days.

(21) Appl. No.: 12/175,296

(22) Filed: Jul. 17, 2008

(65) Prior Publication Data

US 2009/0021571 A1 Jan. 22, 2009

(30) Foreign Application Priority Data

Jul. 20, 2007 (JP) ..... 2007-190022
Mar. 17, 2008 (JP) ..... 2008-067399

(51) Int. Cl.
*B41J 2/45* (2006.01)

(52) U.S. Cl. ..... 347/130; 347/238

(58) Field of Classification Search ..... 347/130, 347/238

See application file for complete search history.

(56) References Cited

U.S. PATENT DOCUMENTS 5,543,830 A * 8/1996 Lea ..... 347/241
6,816,181 B2 11/2004 Ohkubo
6,989,849 B2 1/2006 Nomura et al.
7,382,391 B2 * 6/2008 Kobayashi ..... 347/238
7,411,601 B2 * 8/2008 Kurose et al. ..... 347/238
2003/0048351 A1 3/2003 Ohkubo
2004/0021762 A1 * 2/2004 Seki et al. ..... 347/136
2004/0125196 A1 7/2004 Nomura et al.
2006/0214597 A1 9/2006 Seto
2009/0009876 A1 * 1/2009 Nomura et al. ..... 359/622

FOREIGN PATENT DOCUMENTS

EP 1388807 A1 2/2004
JP 2164561 A 6/1990
JP 11048526 A 2/1999
JP 2003011423 A 1/2003
JP 2006315195 A 11/2006

OTHER PUBLICATIONS

European search report for corresponding European application 08013017.2-1251 lists the references above.

* cited by examiner

*Primary Examiner*—Huan H Tran
(74) *Attorney, Agent, or Firm*—Hogan Lovells US LLP

(57) ABSTRACT

A line head, includes: a substrate which is transmissive and includes a first surface and a second surface facing the first surface; a plurality of light emitting elements which are arranged on the first surface of the substrate and emit light beams; a wiring which is arranged on the first surface of the substrate and is connected with the plurality of light emitting elements; a lens array that includes a plurality of imaging lenses which are arranged facing the light emitting elements at a side of the second surface of the substrate and focus the light beams emitted from the facing light emitting elements to form spots; and an optical sensor which detects the light beams emitted from the light emitting elements and is arranged on the second surface of the substrate.

4 Claims, 27 Drawing Sheets

LINE HEAD AND AN IMAGE FORMING APPARATUS USING THE LINE HEAD

CROSS REFERENCE TO RELATED APPLICATION

The disclosure of Japanese Patent Applications No. 2007-190022 filed on Jul. 20, 2007 and No. 2008-67399 filed on Mar. 17, 2008 including specification, drawings and claims is incorporated herein by reference in its entirety.

BACKGROUND

1. Technical Field

The invention relates to a line head which images light beams emitted from light emitting elements with imaging lenses and an image forming apparatus using the line head.

2. Related Art

As such a line head is known the one including a plurality of light emitting elements arranged in the longitudinal direction of the line head and an optical system for imaging light beams emitted from the plurality of light emitting elements on an image plane. For example, a line head disclosed in JP-A-2-164561 (LED printer head in JP-A-2-164561) includes a plurality of LEDs (light emitting diodes) arranged in a longitudinal direction and a plurality of refractive index distribution type lenses (rod lenses (registered trademark of Mitsubishi Rayon Co., Ltd.) disclosed in JP-A-2-164561) arranged to face the plurality of LEDs. In such a line head, a light beam emitted from one light emitting element is imaged on the same position of an image plane in a superimposed manner by the respective plurality of refractive index distribution type lenses, thereby forming one spot on the image plane. A part where spots are formed in this way is exposed.

SUMMARY

In order to more finely expose the image plane, it is required to reduce the size of the spots. However, the refractive index distribution type lenses have relatively large optical aberrations such as spherical aberration. Accordingly, it has been difficult to obtain fine spots with the line head using the refractive index distribution type lenses.

Further, in the above line head, the light beam from the light emitting element is imaged by being superimposed by the plurality of refractive index distribution type lenses. Accordingly, if the relative positions of the light emitting element and the refractive index distribution type lenses deviate from a desired positional relationship in an optical axis direction, there are cases where an image superimposed by the plurality of refractive index distribution type lenses is split. As a result, the line head using the refractive index distribution type lenses has had a possibility of being unable to perform good exposure due to blurred spots.

Furthermore, problems which could occur in the above line head include a variation in light quantity among the plurality of light emitting elements. The cause of such a light quantity variation may be, for example, a variation in light emission frequency among the plurality of light emitting elements. In other words, if the light emission frequency varies among the plurality of light emitting elements, some of the light emitting elements reach the ends of their lives relatively early and the light quantities thereof decrease in some cases as compared with the other light emitting elements. As a result, there has been a possibility of being unable to realize good exposure.

An advantage of some aspects of the invention is to provide technology capable of forming fine spots while suppressing the above phenomenon of blurring spots, and of realizing good exposure.

Another advantage of some aspects of the invention is to provide technology capable of realizing good exposure by suppressing exposure failures caused by a variation in light quantity among a plurality of light emitting elements.

According to a first aspect of the invention, there is provided a line head, comprising: a substrate which is transmissive and includes a first surface and a second surface facing the first surface; a plurality of light emitting elements which are arranged on the first surface of the substrate and emit light beams; a wiring which is arranged on the first surface of the substrate and is connected with the plurality of light emitting elements; a lens array that includes a plurality of imaging lenses which are arranged facing the light emitting elements at a side of the second surface of the substrate and focus the light beams emitted from the facing light emitting elements to form spots; and an optical sensor which detects the light beams emitted from the light emitting elements and is arranged on the second surface of the substrate.

According to a second aspect of the invention, there is provided an image forming apparatus, comprising: a latent image carrier; and a line head that includes a substrate which is transmissive and has a first surface and a second surface facing the first surface, a plurality of light emitting elements which are arranged on the first surface of the substrate and emit light beams, a wiring which is arranged on the first surface of the substrate and is connected with the plurality of light emitting elements, a lens array that has a plurality of imaging lenses which are arranged facing the light emitting elements at a side of the second surface of the substrate and focus the light beams emitted from the facing light emitting elements to form spots on a surface of the latent image carrier, and an optical sensor which detects the light beams emitted from the light emitting elements and is arranged on the second surface of the substrate.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DESCRIPTION OF EXEMPLARY EMBODIMENTS

First Embodiment

Figure 1:
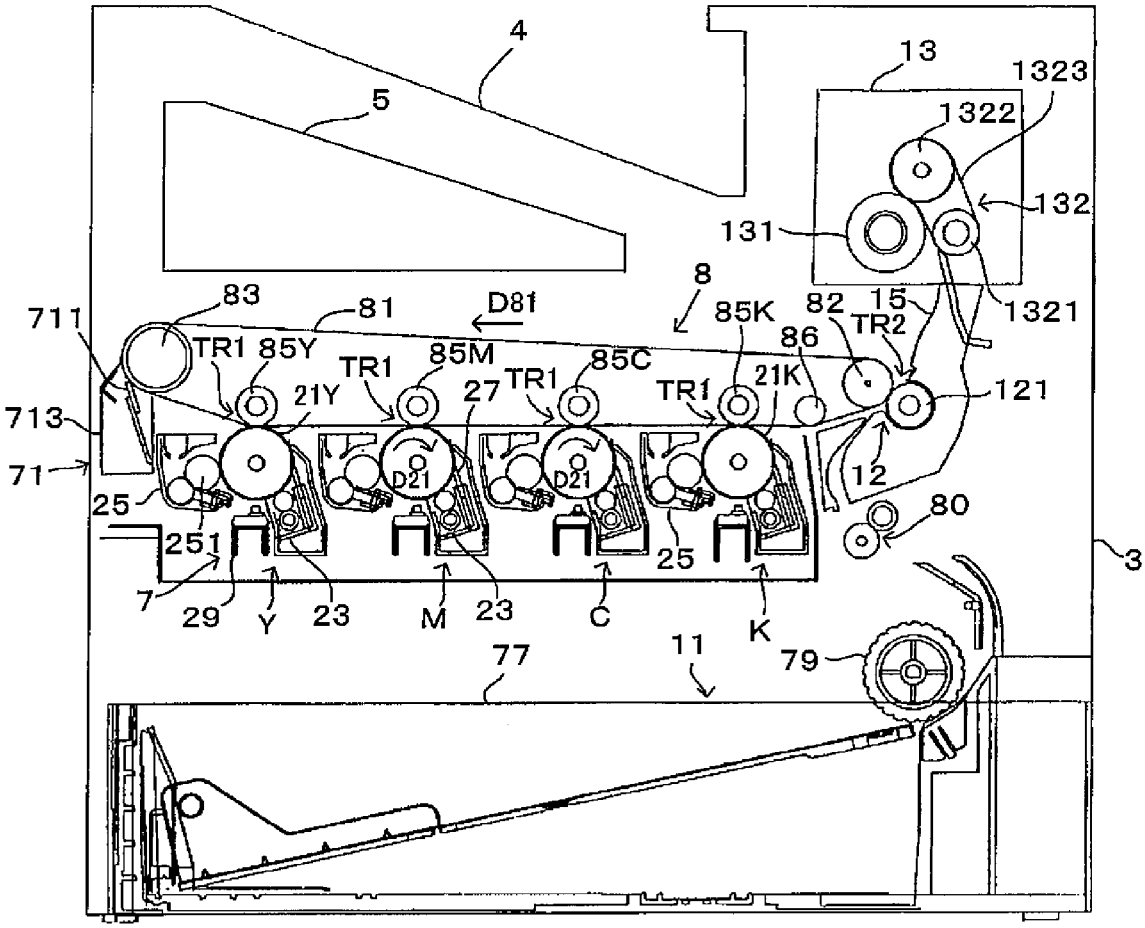
FIG. 1 is a diagram showing an image forming apparatus which includes a first embodiment of a line head according to the invention.
Figure 2:
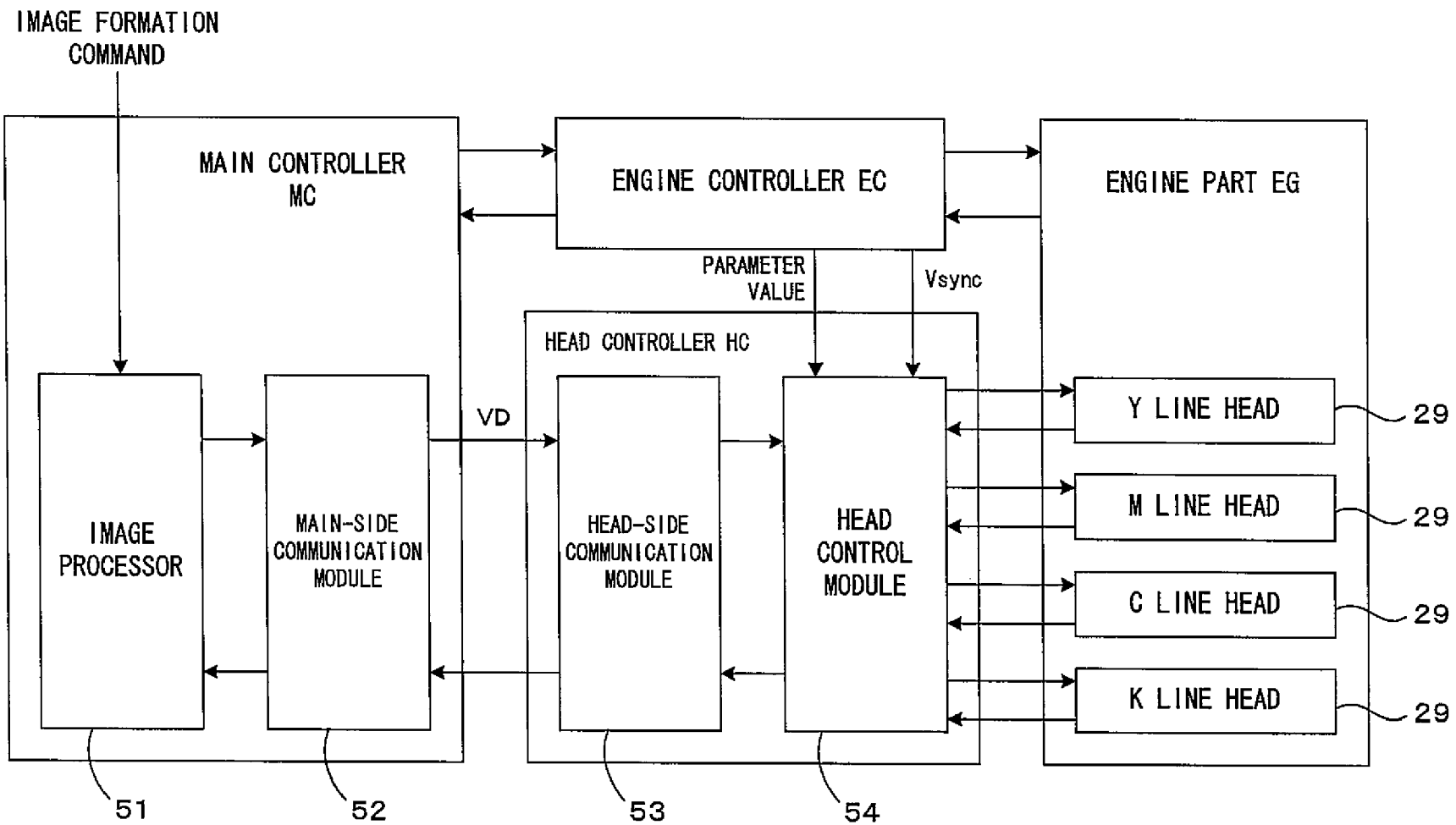
FIG. 2 is a diagram showing the electrical construction of the image forming apparatus of FIG. 1.

FIG. 1 is a diagram showing an image forming apparatus which includes a first embodiment of a line head according to the invention, and FIG. 2 is a diagram showing the electrical construction of the image forming apparatus of FIG. 1. This apparatus is an image forming apparatus that can selectively execute a color mode for forming a color image by superimposing four color toners of black (K), cyan (C), magenta (M) and yellow (Y) and a monochromatic mode for forming a monochromatic image using only black (K) toner. FIG. 1 is a diagram corresponding to the execution of the color mode. In this image forming apparatus, when an image formation command is given from an external apparatus such as a host computer to a main controller MC having a CPU and memories, the main controller MC feeds a control signal and the like to an engine controller EC and feeds video data VD corresponding to the image formation command to a head controller HC. This head controller HC controls line heads 29 of the respective colors based on the video data VD from the main controller MC, a vertical synchronization signal Vsync from the engine controller EC and parameter values from the engine controller EC. In this way, an engine part EG performs a specified image forming operation to form an image corresponding to the image formation command on a sheet such as a copy sheet, transfer sheet, form sheet or transparent sheet for OHP.

An electrical component box 5 having a power supply circuit board, the main controller MC, the engine controller EC and the head controller HC built therein is disposed in a housing main body 3 of the image forming apparatus according to this embodiment. An image forming unit 7, a transfer belt unit 8 and a sheet feeding unit 11 are also arranged in the housing main body 3. A secondary transfer unit 12, a fixing unit 13, and a sheet guiding member 15 are arranged at the right side in the housing main body 3 in FIG. 1. It should be noted that the sheet feeding unit 11 is detachably mountable into the housing main body 3. The sheet feeding unit 11 and the transfer belt unit 8 are so constructed as to be detachable for repair or exchange respectively.

The image forming unit 7 includes four image forming stations Y (for yellow), M (for magenta), C (for cyan) and K (for black) which form a plurality of images having different colors. Each of the image forming stations Y, M, C and K includes a cylindrical photosensitive drum 21 having a surface of a specified length in a main scanning direction MD. Each of the image forming stations Y, M, C and K forms a toner image of the corresponding color on the surface of the photosensitive drum 21. The photosensitive drum is arranged so that the axial direction thereof is substantially parallel to the main scanning direction MD. Each photosensitive drum 21 is connected to its own driving motor and is driven to rotate at a specified speed in a direction of arrow D21 in FIG. 1, whereby the surface of the photosensitive drum 21 is transported in a sub scanning direction SD which is substantially orthogonal to the main scanning direction MD. Further, a charger 23, the line head 29, a developer 25 and a photosensitive drum cleaner 27 are arranged in a rotating direction around each photosensitive drum 21. A charging operation, a latent image forming operation and a toner developing operation are performed by these functional sections. Accordingly, a color image is formed by superimposing toner images formed by all the image forming stations Y, M, C and K on a transfer belt 81 of the transfer belt unit 8 at the time of executing the color mode, and a monochromatic image is formed using only a toner image formed by the image forming station K at the time of executing the monochromatic mode. Meanwhile, since the respective image forming stations of the image forming unit 7 are identically constructed, reference characters are given to only some of the image forming stations while being not given to the other image forming stations in order to facilitate the diagrammatic representation in FIG. 1.

The charger 23 includes a charging roller having the surface thereof made of an elastic rubber This charging roller is constructed to be rotated by being held in contact with the surface of the photosensitive drum 21 at a charging position. As the photosensitive drum 21 rotates, the charging roller is rotated at the same circumferential speed in a direction driven by the photosensitive drum 21. This charging roller is connected to a charging bias generator (not shown) and charges the surface of the photosensitive drum 21 at the charging position where the charger 23 and the photosensitive drum 21 are in contact upon receiving the supply of a charging bias from the charging bias generator.

The line head 29 is arranged relative to the photosensitive drum 21 so that the longitudinal direction thereof corresponds to the main scanning direction MD and the width direction thereof corresponds to the sub scanning direction SD. Hence, the longitudinal direction of the line head 29 is substantially parallel to the main scanning direction MD. The line head includes a plurality of light emitting elements arrayed in the longitudinal direction and is positioned separated from the photosensitive drum 21. Light beams are emitted from these light emitting elements to irradiate (in other words, expose) the surface of the photosensitive drum 21 charged by the charger 23, thereby forming a latent image on this surface. In this embodiment, the head controller HC is provided to control the line heads 29 of the respective colors, and controls the respective line heads 29 based on the video data VD from the main controller MC and a signal from the engine controller EC. Specifically, in this embodiment, image data included in an image formation command is inputted to an image processor 51 of the main controller MC. Then, video data VD of the respective colors are generated by applying various image processings to the image data, and the video data VD are fed to the head controller HC via a main-side communication module 52. In the head controller HC, the video data VD are fed to a head control module 54 via a head-side communication module 53. Signals representing parameter values relating to the formation of a latent image and the vertical synchronization signal Vsync are fed to this head control module 54 from the engine controller EC as described above. Based on these signals, the video data VD and the like, the head controller HC generates signals for controlling the driving of the elements of the line heads 29 of the respective colors and outputs them to the respective line heads 29. In this way, the operations of the light emitting elements in the respective line heads 29 are suitably controlled to form latent images corresponding to the image formation command.

In this embodiment, the photosensitive drum 21, the charger 23, the developer 25 and the photosensitive drum cleaner 27 of each of the image forming stations Y, M, C and K are unitized as a photosensitive cartridge. Further, each photosensitive cartridge includes a nonvolatile memory for storing information on the photosensitive cartridge. Wireless communication is performed between the engine controller EC and the respective photosensitive cartridges. By doing so, the information on the respective photosensitive cartridges is transmitted to the engine controller EC and information in the respective memories can be updated and stored.

The developer 25 includes a developing roller 251 carrying toner on the surface thereof. By a development bias applied to the developing roller 251 from a development bias generator (not shown) electrically connected to the developing roller 251, charged toner is transferred from the developing roller 251 to the photosensitive drum 21 to develop the latent image formed by the line head 29 at a development position where the developing roller 251 and the photosensitive drum 21 are in contact.

The toner image developed at the development position in this way is primarily transferred to the transfer belt 81 at a primary transfer position TR1 to be described later where the transfer belt 81 and each photosensitive drum 21 are in contact after being transported in the rotating direction D21 of the photosensitive drum 21.

Further, in this embodiment, the photosensitive drum cleaner 27 is disposed in contact with the surface of the photosensitive drum 21 downstream of the primary transfer position TR1 and upstream of the charger 23 with respect to the rotating direction D21 of the photosensitive drum 21. This photosensitive drum cleaner 27 removes the toner remaining on the surface of the photosensitive drum 21 to clean after the primary transfer by being held in contact with the surface of the photosensitive drum.

The transfer belt unit 8 includes a driving roller 82, a driven roller (blade facing roller) 83 arranged to the left of the driving roller 82 in FIG. 1, and the transfer belt 81 mounted on these rollers and driven to turn in a direction of arrow D81 in FIG. 1 (conveying direction). The transfer belt unit 8 also includes four primary transfer rollers 85Y, 85M, 85C and 85K arranged to face in a one-to-one relationship with the photosensitive drums 21 of the respective image forming stations Y, M, C and K inside the transfer belt 81 when the photosensitive cartridges are mounted. These primary transfer rollers 85Y, 85M, 85C and 85K are respectively electrically connected to a primary transfer bias generator not shown. As described in detail later, at the time of executing the color mode, all the primary transfer rollers 85Y, 85M, 85C and 85K are positioned on the sides of the image forming stations Y, M, C and K as shown in FIG. 1, whereby the transfer belt 81 is pressed into contact with the photosensitive drums 21 of the image forming stations Y, M, C and K to form the primary transfer positions TR1 between the respective photosensitive drums 21 and the transfer belt 81. By applying primary transfer biases from the primary transfer bias generator to the primary transfer rollers 85Y, 85M, 85C and 85K at suitable timings, the toner images formed on the surfaces of the respective photosensitive drums 21 are transferred to the surface of the transfer belt 81 at the corresponding primary transfer positions TR1 to form a color image.

On the other hand, out of the four primary transfer rollers 85Y, 85M, 85C and 85K, the color primary transfer rollers 85Y, 85M, 85C are separated from the facing image forming stations Y, M and C and only the monochromatic primary transfer roller 85K is brought into contact with the image forming station K at the time of executing the monochromatic mode, whereby only the monochromatic image forming station K is brought into contact with the transfer belt 81. As a result, the primary transfer position TR1 is formed only between the monochromatic primary transfer roller 85K and the image forming station K. By applying a primary transfer bias at a suitable timing from the primary transfer bias generator to the monochromatic primary transfer roller 85K, the toner image formed on the surface of the photosensitive drum 21 is transferred to the surface of the transfer belt 81 at the primary transfer position TR1 to form a monochromatic image.

The transfer belt unit 8 further includes a downstream guide roller 86 disposed downstream of the monochromatic primary transfer roller 85K and upstream of the driving roller 82. This downstream guide roller 86 is so disposed as to come into contact with the transfer belt 81 on an internal common tangent to the primary transfer roller 85K and the photosensitive drum 21 at the primary transfer position TR1 formed by the contact of the monochromatic primary transfer roller 85K with the photosensitive drum 21 of the image forming station K.

The driving roller 82 drives to rotate the transfer belt 81 in the direction of the arrow D81 and doubles as a backup roller for a secondary transfer roller 121. A rubber layer having a thickness of about 3 mm and a volume resistivity of 1000 kΩ·cm or lower is formed on the circumferential surface of the driving roller 82 and is grounded via a metal shaft, thereby serving as an electrical conductive path for a secondary transfer bias to be supplied from an unillustrated secondary transfer bias generator via the secondary transfer roller 121. By providing the driving roller 82 with the rubber layer having high friction and shock absorption, an impact caused upon the entrance of a sheet into a contact part (secondary transfer position TR2) of the driving roller 82 and the secondary transfer roller 121 is unlikely to be transmitted to the transfer belt 81 and image deterioration can be prevented.

The sheet feeding unit 11 includes a sheet feeding section which has a sheet cassette 77 capable of holding a stack of sheets, and a pickup roller 79 which feeds the sheets one by one from the sheet cassette 77. The sheet fed from the sheet feeding section by the pickup roller 79 is fed to the secondary transfer position TR2 along the sheet guiding member 15 after having a sheet feed timing adjusted by a pair of registration rollers 80.

The secondary transfer roller 121 is provided freely to abut on and move away from the transfer belt 81, and is driven to abut on and move away from the transfer belt 81 by a secondary transfer roller driving mechanism (not shown). The fixing unit 13 includes a heating roller 131 which is freely rotatable and has a heating element such as a halogen heater built therein, and a pressing section 132 which presses this heating roller 131. The sheet having an image secondarily transferred to the front side thereof is guided by the sheet guiding member 15 to a nip portion formed between the heating roller 131 and a pressure belt 1323 of the pressing section 132, and the image is thermally fixed at a specified temperature in this nip portion. The pressing section 132 includes two rollers 1321 and 1322 and the pressure belt 1323 mounted on these rollers. Out of the surface of the pressure belt 1323, a part stretched by the two rollers 1321 and 1322 is pressed against the circumferential surface of the heating roller 131, thereby forming a sufficiently wide nip portion between the heating roller 131 and the pressure belt 1323. The sheet having been subjected to the image fixing operation in this way is transported to the discharge tray 4 provided on the upper surface of the housing main body 3.

Further, a cleaner 71 is disposed facing the blade facing roller 83 in this apparatus. The cleaner 71 includes a cleaner blade 711 and a waste toner box 713. The cleaner blade 711 removes foreign matters such as toner remaining on the transfer belt after the secondary transfer and paper powder by holding the leading end thereof in contact with the blade facing roller 83 via the transfer belt 81. Foreign matters thus removed are collected into the waste toner box 713. Further, the cleaner blade 711 and the waste toner box 713 are constructed integral to the blade facing roller 83. Accordingly, if the blade facing roller 83 moves as described next, the cleaner blade 711 and the waste toner box 713 move together with the blade facing roller 83.

Figure 3:
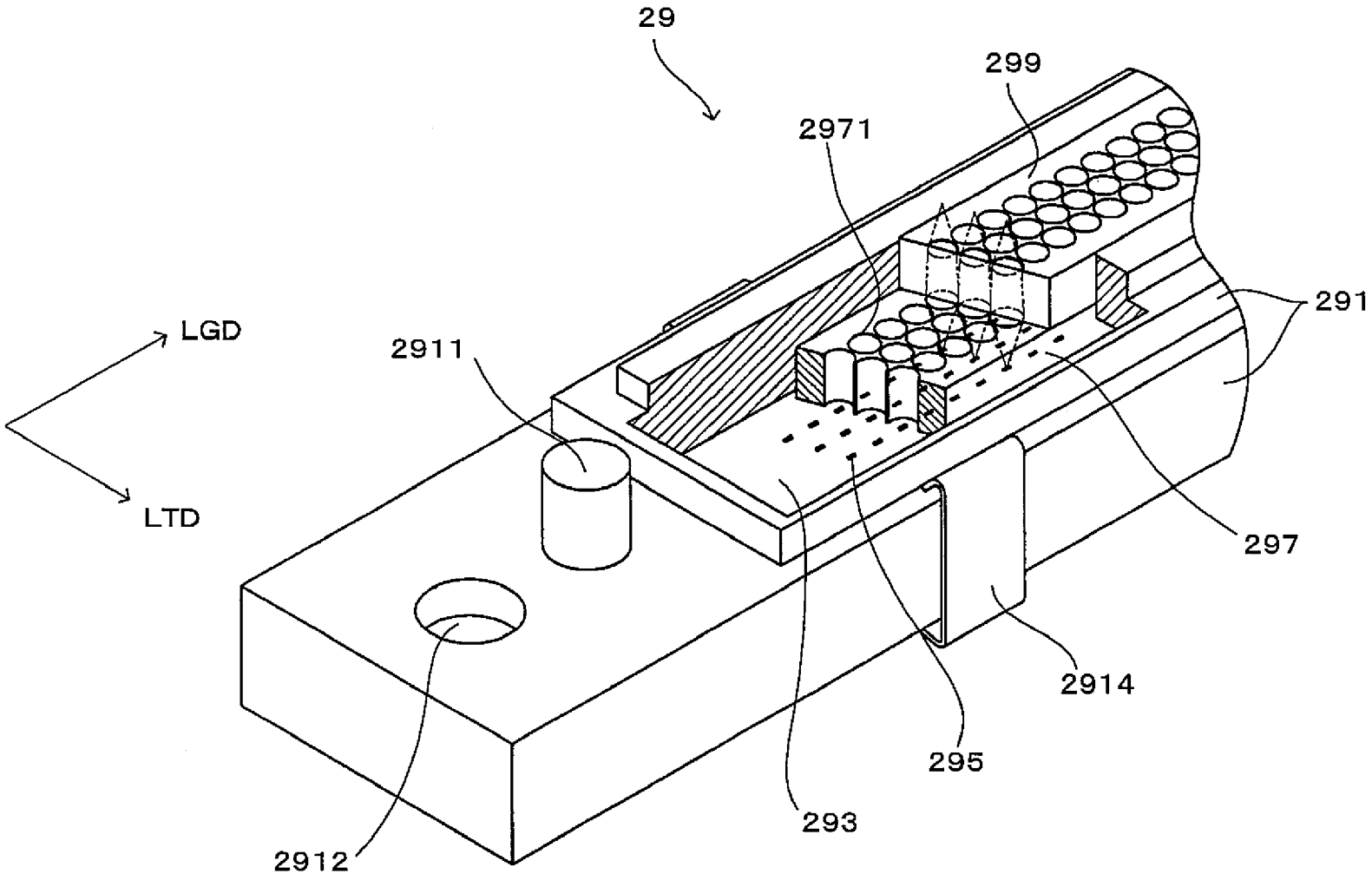
FIG. 3 is a perspective view schematically showing a line head of this embodiment according to the invention.
Figure 4:
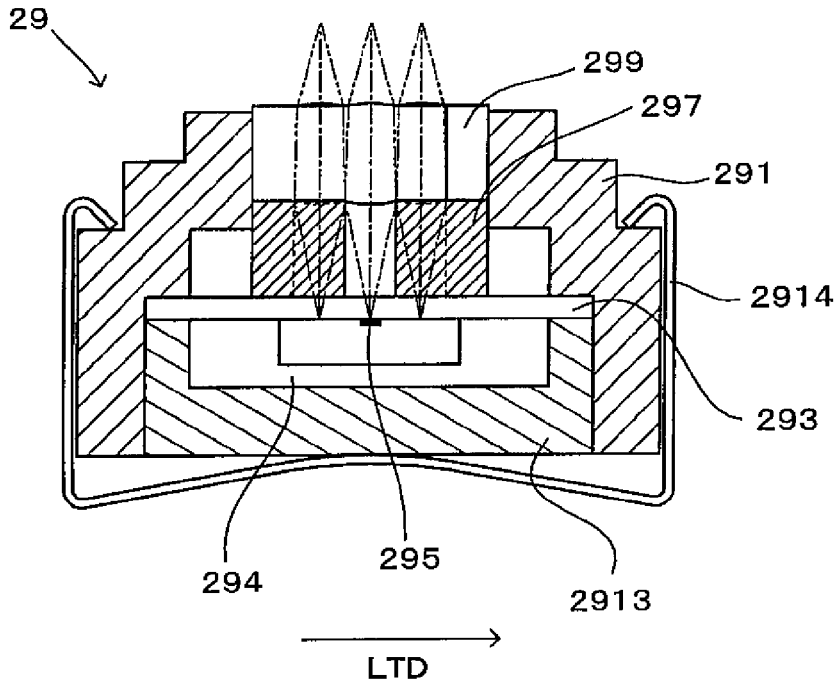
FIG. 4 is a sectional view along a width direction of the line head shown in FIG. 3.

FIG. 3 is a perspective view schematically showing a line head of this embodiment according to the invention, and FIG. 4 is a sectional view along a width direction of the line head shown in FIG. 3. As described above, the line head 29 is arranged to face the photosensitive drum 21 such that the longitudinal direction LGD corresponds to the main scanning direction MD and the width direction LTD corresponds to the sub scanning direction SD. The longitudinal direction LGD and the width direction LTD are substantially normal to each other. The line head 29 of this embodiment includes a case 291, and a positioning pin 2911 and a screw insertion hole 2912 are provided at each of the opposite ends of such a case 291 in the longitudinal direction LGD. The line head 29 is positioned relative to the photosensitive drum 21 by fitting such positioning pins 2911 into positioning holes (not shown) perforated in a photosensitive drum cover (not shown) covering the photosensitive drum 21 and positioned relative to the photosensitive drum 21. Further, the line head 29 is positioned and fixed relative to the photosensitive drum 21 by screwing fixing screws into screw holes (not shown) of the photosensitive drum cover via the screw insertion holes 2912 to be fixed.

The case 291 carries a lens array 299 at a position facing the surface of the photosensitive drum 21, and includes a light shielding member 297 and a head substrate 293 inside, the light shielding member 297 being closer to the lens array 299 than the head substrate 293. The head substrate 293 is made of a transmissive material (glass for instance). Further, a plurality of light emitting element groups 295 are provided on an under surface of the head substrate 293 (surface opposite to the lens array 299 out of two surfaces of the head substrate 293). Specifically, the plurality of light emitting element groups 295 are two-dimensionally arranged on the under surface of the head substrate 293 while being spaced by specified distances in the longitudinal direction LGD and the width direction LTD. Here, each light emitting element group 295 is formed by two-dimensionally arraying a plurality of light emitting elements. This is described in detail later. In this embodiment, bottom emission-type EL (electroluminescence) devices are used as the light emitting elements. In other words, the organic EL devices are arranged as light emitting elements on the under surface of the head substrate 293 in this embodiment. Thus, all the light emitting elements 2951 are arranged on the same plane (under surface of the head substrate 293). When the respective light emitting elements are driven by a drive circuit formed on the head substrate 293, light beams are emitted from the light emitting elements in directions toward the photosensitive drum 21. These light beams propagate toward the light shielding member 297 after passing through the head substrate 293 from the under surface thereof to a top surface thereof.

The light shielding member 297 is perforated with a plurality of light guide holes 2971 in a one-to-one correspondence with the plurality of light emitting element groups 295. The light guide holes 2971 are substantially cylindrical holes penetrating the light shielding member 297 and having central axes in parallel with normals to the head substrate 293. Accordingly, out of light beams emitted from the light emitting element groups 295, those propagating toward other than the light guide holes 2971 corresponding to the light emitting element groups 295 are shielded by the light shielding member 297. In this way, all the lights emitted from one light emitting element group 295 propagate toward the lens array 299 via the same light guide hole 2971 and the mutual interference of the light beams emitted from different light emitting element groups 295 can be prevented by the light shielding member 297. The light beams having passed through the light guide holes 2971 perforated in the light shielding member 297 are imaged as spots on the surface of the photosensitive drum 21 by the lens array 299.

As described above, in this line head, the light shielding member 297 is arranged between the head substrate 293 and the lens array 299. This light shielding member 297 is formed with the light guide holes 2971 penetrating from the light emitting elements 2951 toward lenses LS facing the light emitting elements 2951. Thus, crosstalk, in which unnecessary lights are incident on the lenses LS, is suppressed and satisfactory spot formation is possible.

As shown in FIG. 4, an underside lid 2913 is pressed against the case 291 via the head substrate 293 by retainers 2914. Specifically, the retainers 2914 have elastic forces to press the underside lid 2913 toward the case 291, and seal the inside of the case 291 light-tight (that is, so that light does not leak from the inside of the case 291 and so that light does not intrude into the case 291 from the outside) by pressing the underside lid by means of the elastic force. It should be noted that a plurality of the retainers 2914 are provided at a plurality of positions in the longitudinal direction of the case 291. The light emitting element groups 295 are covered with a sealing member 294.

Figure 5:
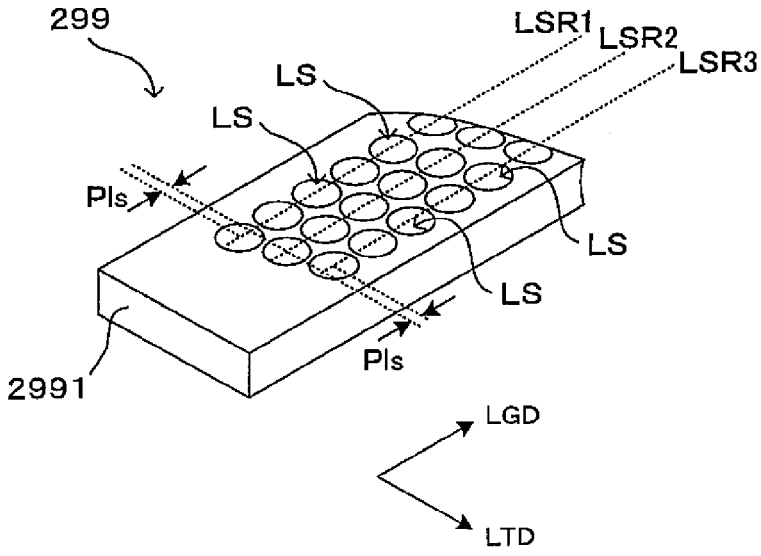
FIG. 5 is a schematic partial perspective view of the lens array.
Figure 6:
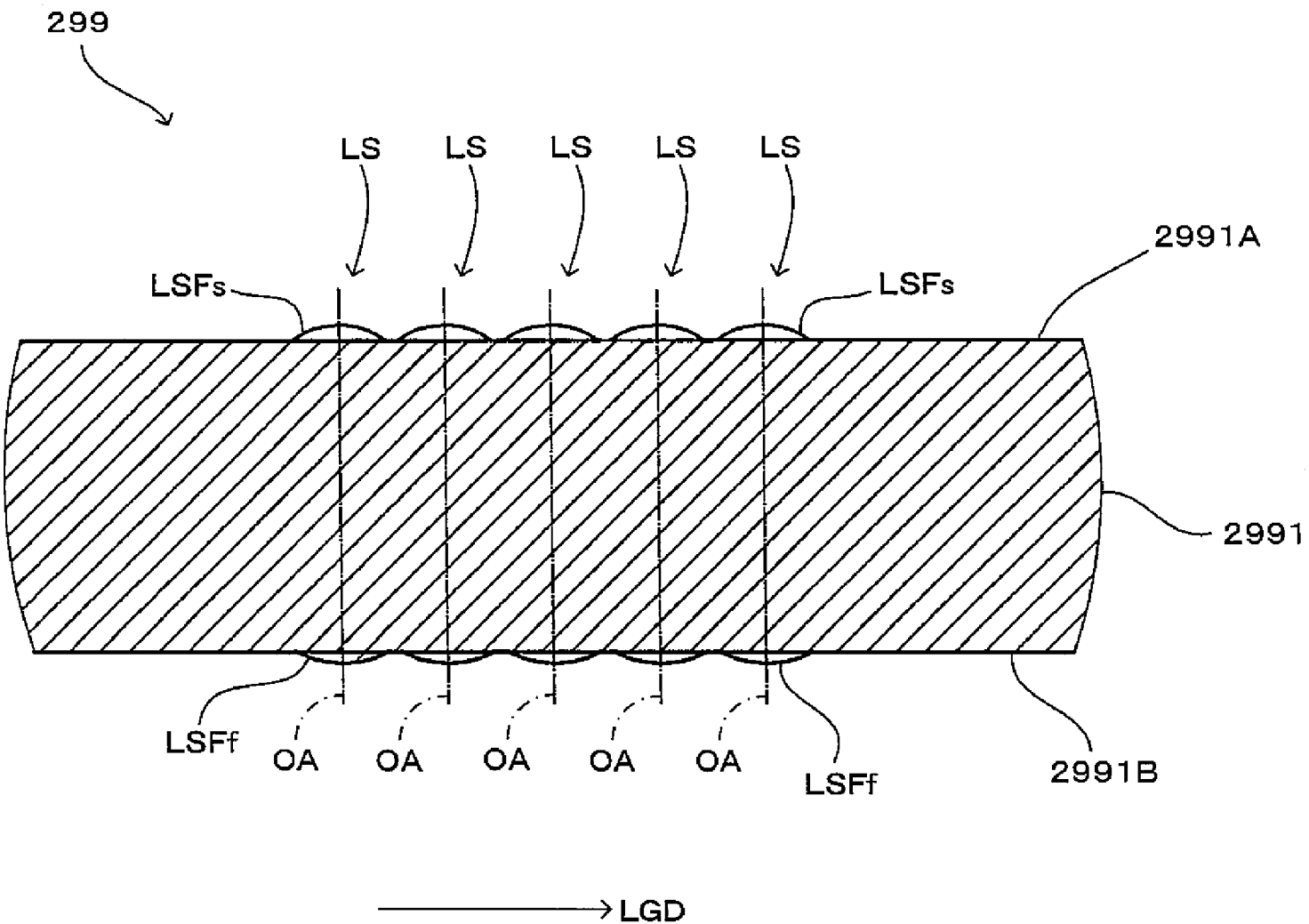
FIG. 6 is a sectional view of the lens array in the longitudinal direction.

FIG. 5 is a schematic partial perspective view of the lens array, and FIG. 6 is a sectional view of the lens array in the longitudinal direction LGD. The lens array 299 includes a lens substrate 2991. First surfaces LSFf of lenses LS are formed on an under surface 2991B of the lens substrate 2991, and second surfaces LSFs of the lenses LS are formed on a top surface 2991A of the lens substrate 2991. The first and second surfaces LSFf, LSFs facing each other and the lens substrate 2991 held between these two surfaces function as one lens LS. The first and second surfaces LSFf, LSFs of the lenses LS can be made of resin for instance.

The lens array 299 is arranged such that optical axes OA of the plurality of lenses LS are substantially parallel to each other. The lens array 299 is also arranged such that the optical axes OA of the lenses LS are substantially normal to the under surface (surface where the light emitting elements 2951 are arranged) of the head substrate 293. At this time, these plurality of lenses LS are arranged in a one-to-one correspondence with the plurality of light emitting element groups 295. Specifically, the plurality of lenses LS are two-dimensionally arranged while being spaced apart at specified pitches in the longitudinal direction LGD and the width direction LTD in conformity with the arrangement of the light emitting element groups 295. More specifically, a plurality of lens rows LSR, in each of which a plurality of lenses LS are aligned in the longitudinal direction LGD, are arranged in the width direction LTD. In other words, the plurality of lens rows LSR are arranged at mutually different positions in the width direction LTD. In this embodiment, three lens rows LSR1, LSR2 and LSR3 are arranged in the width direction LTD. The three lens rows LSR1 to LSR3 are displaced from each other by a specified lens pitch Pls in the longitudinal direction.

Figure 7:
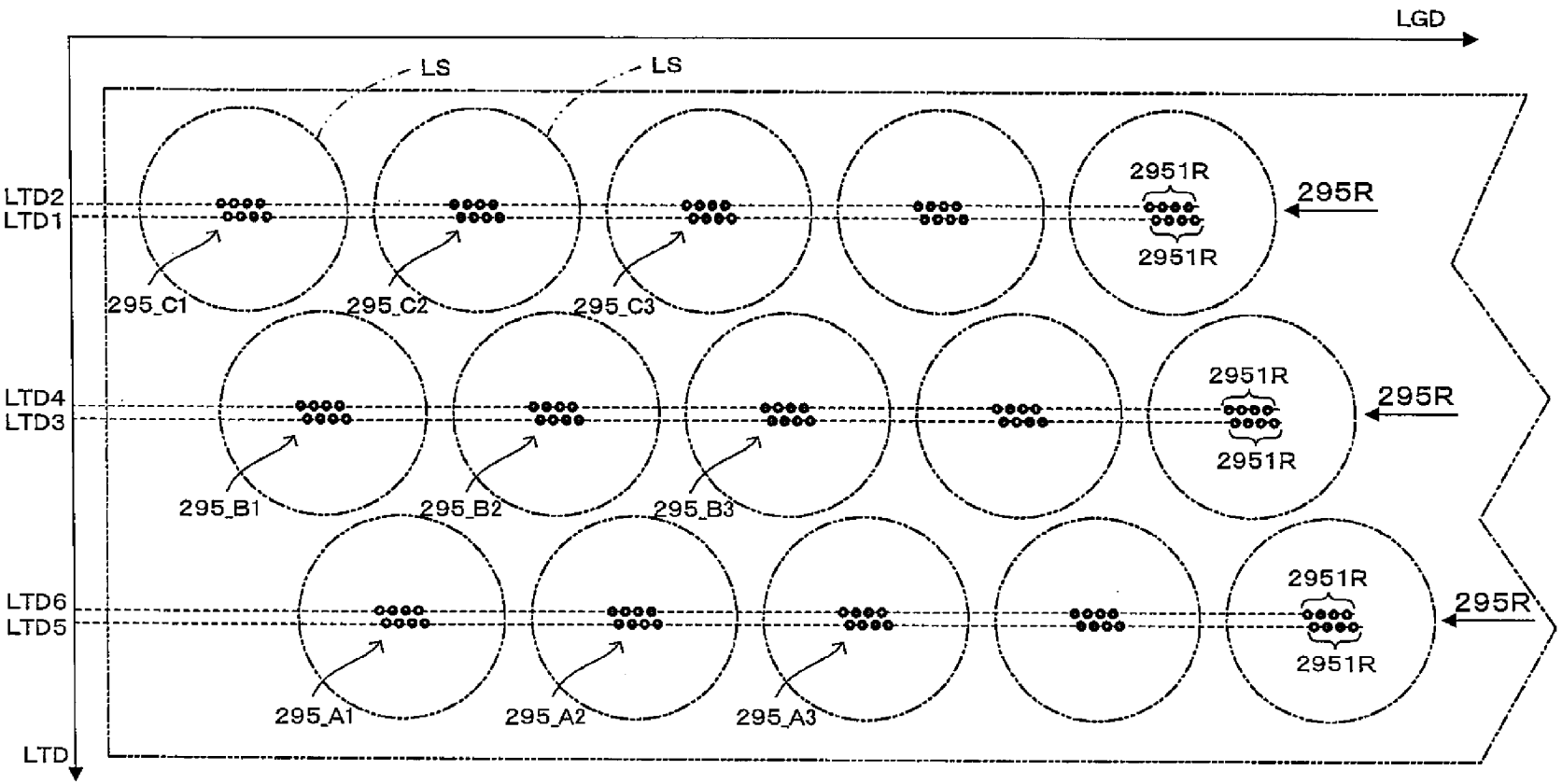
FIG. 7 is a diagram showing the arrangement of the light emitting element groups in the line head.
Figure 8:
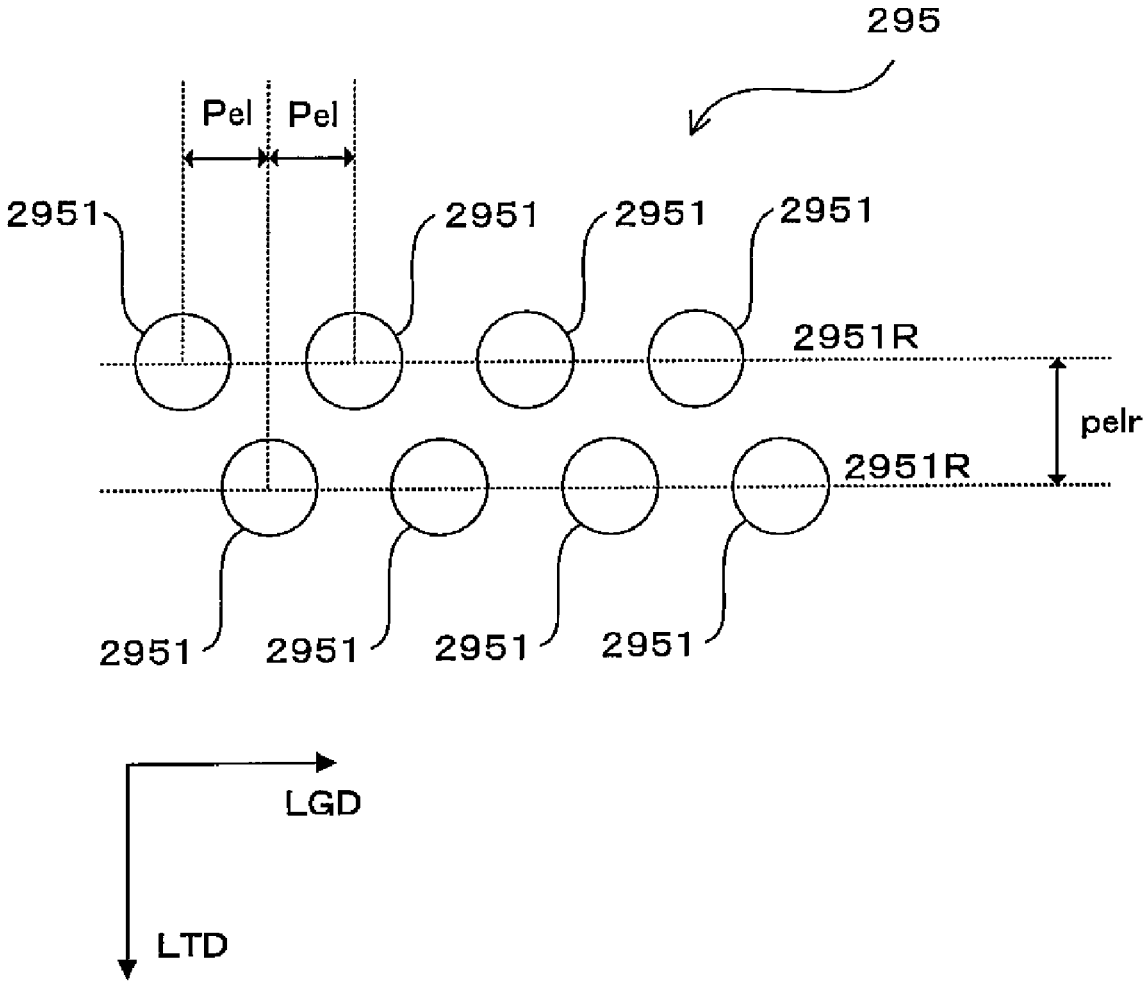
FIG. 8 is a diagram showing the arrangement of the light emitting elements in each light emitting element group.

FIG. 7 is a diagram showing the arrangement of the light emitting element groups in the line head, and FIG. 8 is a diagram showing the arrangement of the light emitting elements in each light emitting element group. In this embodiment, eight light emitting elements 2951 are aligned at specified element pitches Pel in the longitudinal direction LGD in each light emitting element group 295. In each light emitting element group 295 of this embodiment, two light emitting element rows 2951R each formed by aligning four light emitting elements 2951 at specified pitches (twice the element pitch Pel) in the longitudinal direction LGD are arranged while being spaced apart by an element row pitch Pelr in the width direction LTD. As a result, eight light emitting elements 2951 are arranged in a staggered manner in each of the light emitting element groups 295. The plurality of light emitting element groups 295 are arranged as follows.

Specifically, the plurality of light emitting element groups 295 are arranged such that three light emitting element group rows 295R each formed by aligning a specified number of light emitting element groups 295 in the longitudinal direction LGD are arranged in the width direction LTD. All the light emitting element groups 295 are arranged at mutually different longitudinal-direction positions. Further, the plurality of light emitting element groups 295 are arranged such that the light emitting element groups adjacent in the longitudinal direction (light emitting element groups 295_C1 and 295_B1 for example) differ in their width-direction positions. In this specification, it is defined that the position of each light emitting element is the geometric center of gravity thereof and that the position of the light emitting element group 295 is the geometric center of gravity of the positions of all the light emitting elements belonging to the same light emitting element group 295. The longitudinal-direction position and the width-direction position mean a longitudinal-direction component and a width-direction component of a particular position, respectively.

The light guide holes 2971 are perforated in the light shielding member 297 and the lenses LS are arranged in conformity with the arrangement of the above light emitting element groups 295. In other words, in this embodiment, the center of gravity positions of the light emitting element groups 295, the center axes of the light guide holes 2971 and the optical axes OA of the lenses LS substantially coincide. Light beams emitted from the light emitting elements 2951 of the light emitting element groups 295 are incident on the lens array 299 via the corresponding light guide holes 2971 and focused as spots on the surface of the photosensitive drum 21 by the lens array 299.

Figure 9:
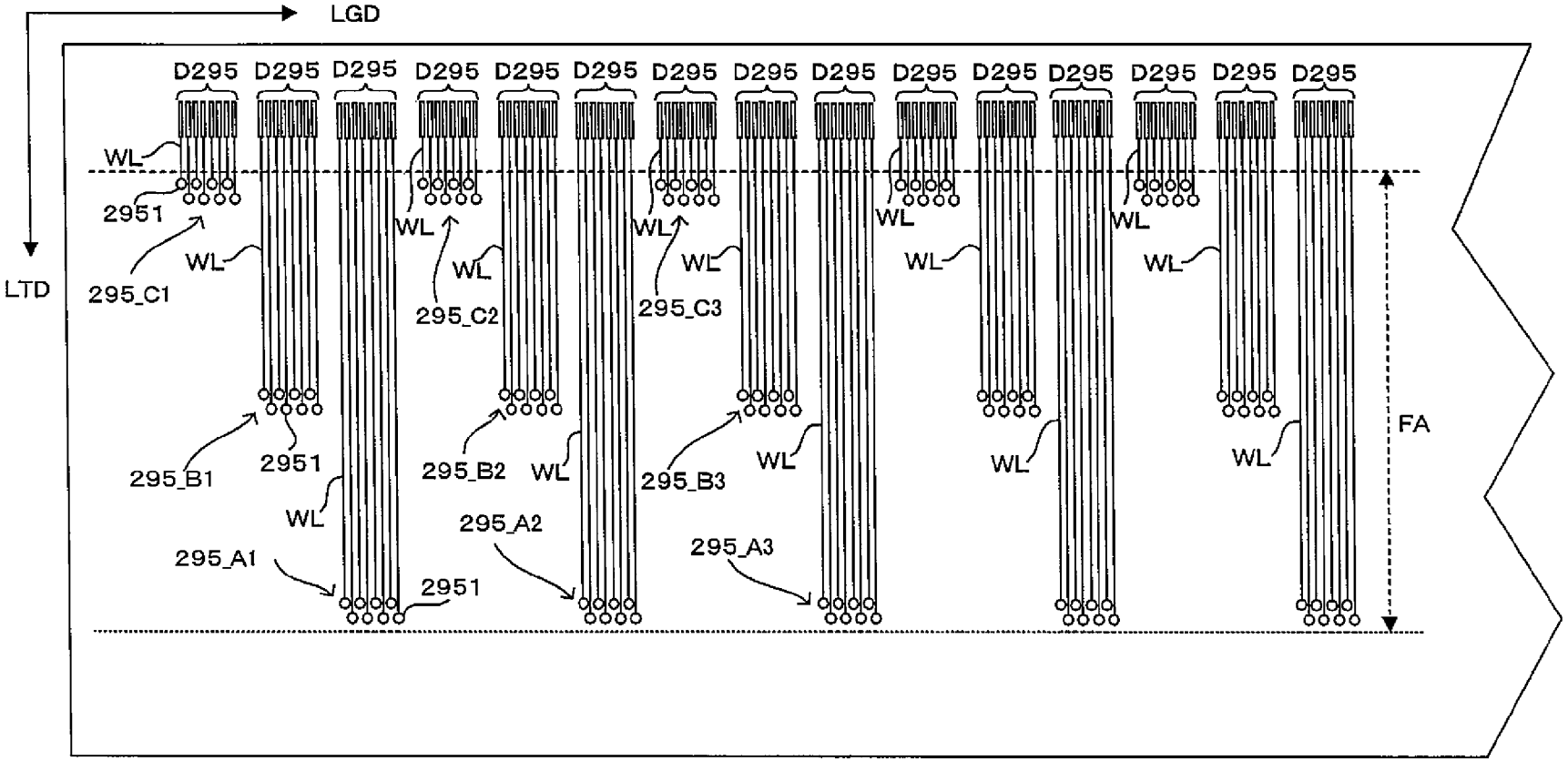
FIG. 9 is a diagram showing the light emitting elements and other members arranged on the under surface of the head substrate.

FIG. 9 is a diagram showing the light emitting elements and other members arranged on the under surface of the head substrate. FIG. 9 corresponds to a case when the members arranged on the under surface of the head substrate 293 are seen from the top surface of the head substrate 293. As described above, the light emitting elements 2951 are arranged on the under surface of the head substrate 293. Further; in this embodiment, driving circuits D295 for driving the light emitting elements 2951 and wiring WL connecting the light emitting elements 2951 and the driving circuits D295 are arranged on the under surface of the head substrate 293. As shown in FIG. 9, all the driving circuits D295 are arranged at one side in the width direction LTD with respect to an element forming area FA (more specifically, at an upstream side in the width direction LTD with respect to the element forming area FA). Here, the element forming area FA is an area of the under surface of the head substrate 293 where the light emitting elements 2951 are formed. The wiring WL is drawn out from each light emitting element group toward the driving circuit D295 corresponding to this light emitting element group. In other words, one end of the wiring WL is connected with the light emitting elements 2951 and the other end thereof is connected with the driving circuit D295. Accordingly, drive signals outputted from the driving circuit D295 are inputted to the light emitting elements 2951 via the wiring WL. The light emitting elements 2951 emit light beams in accordance with the inputted drive signals. It should be noted that TFTs (thin film transistors) can be, for example, used as the driving circuits D295.

Figure 10:
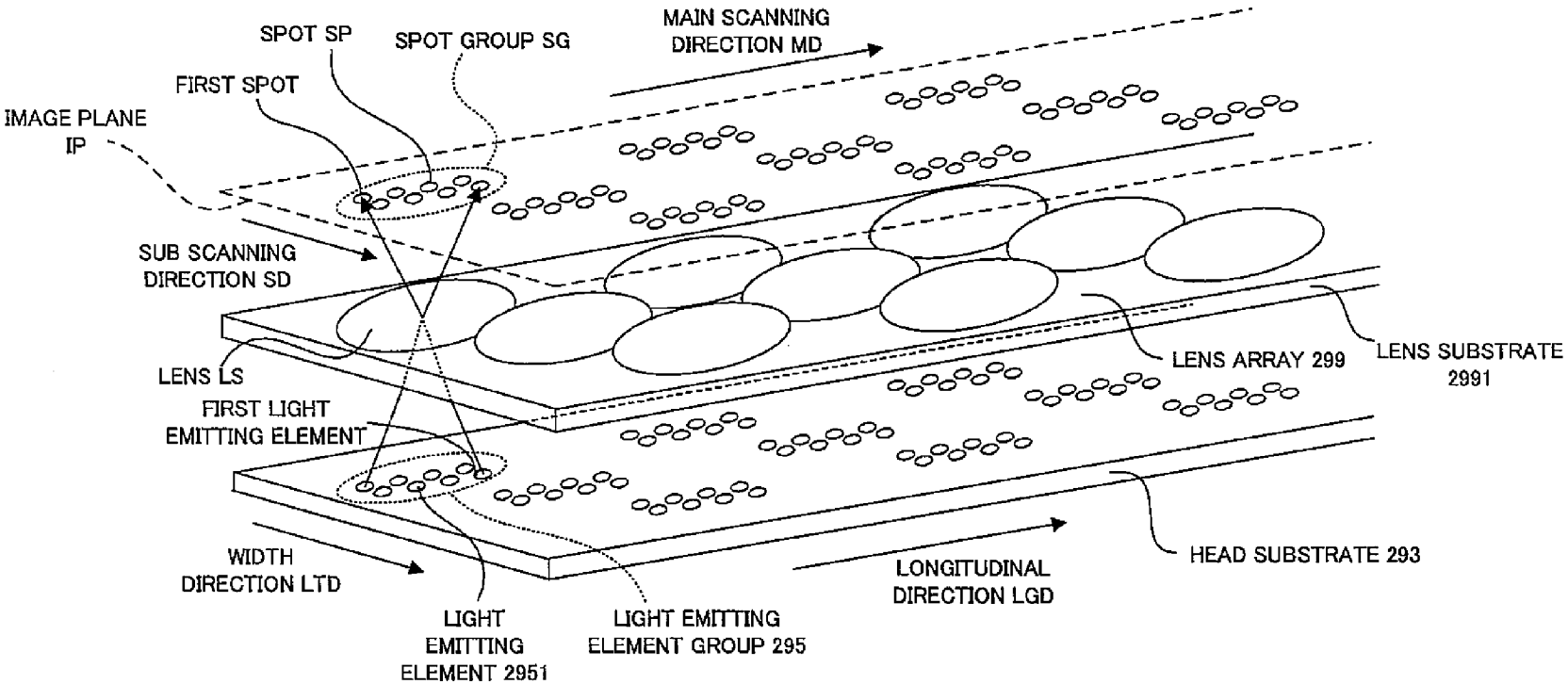
FIGS. 10 and 11 are diagrams showing terminology used in this specification.
Figure 11:
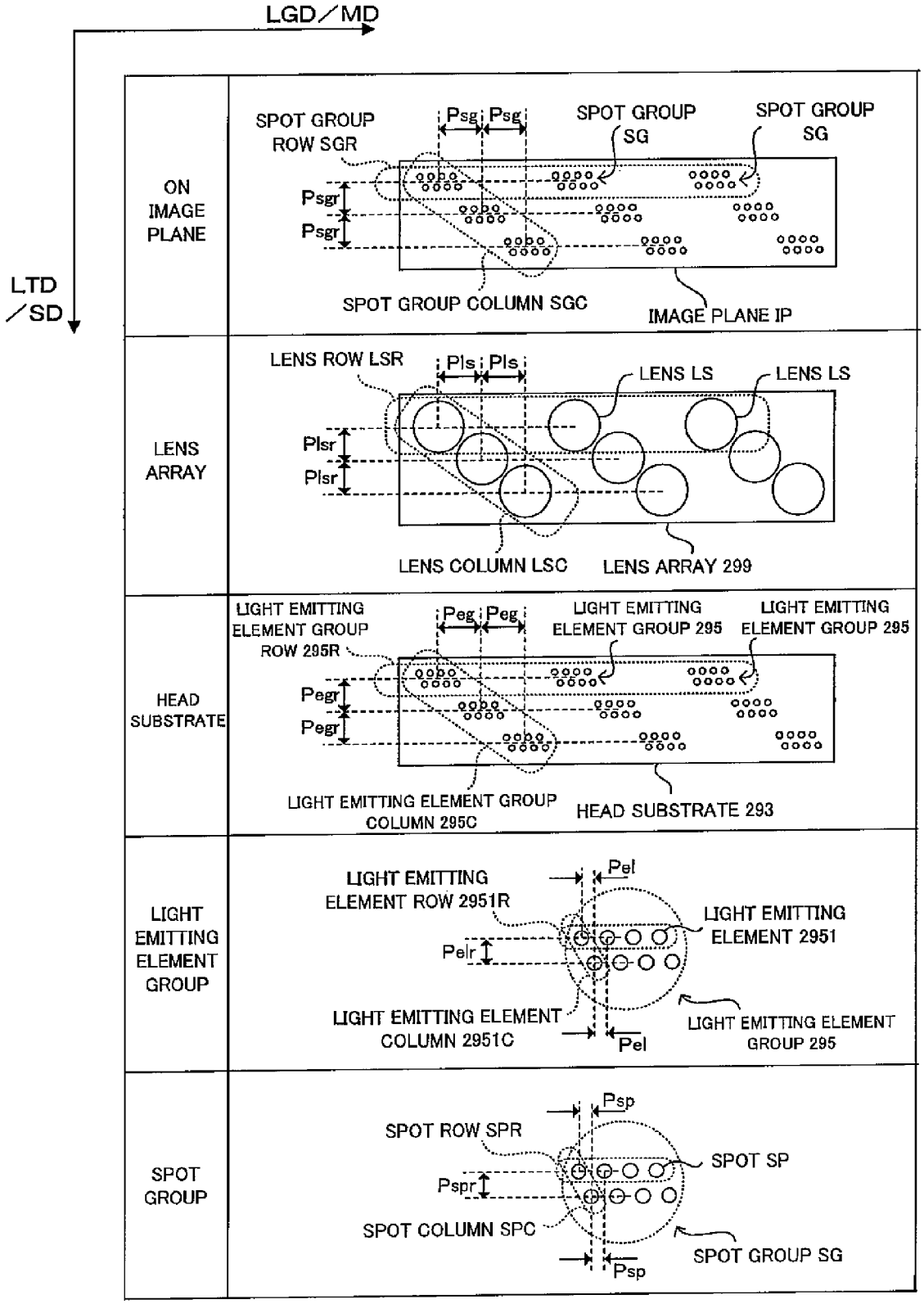

FIGS. 10 and 11 are diagrams showing terminology used in this specification. Here, terminology used in this specification is organized with reference to FIGS. 10 and 11. In this specification, as described above, a conveying direction of the surface (image plane IP) of the photosensitive drum 21 is defined to be the sub scanning direction SD and a direction substantially normal to the sub scanning direction SD is defined to be the main scanning direction MD. Further, a line head 29 is arranged relative to the surface (image plane IP) of the photosensitive drum 21 such that its longitudinal direction LGD corresponds to the main scanning direction MD and its width direction LTD corresponds to the sub scanning direction SD.

Collections of a plurality of (eight in FIGS. 10 and 11) light emitting elements 2951 arranged on the head substrate 293 in one-to-one correspondence with the plurality of lenses LS of the lens array 299 are defined to be light emitting element groups 295. In other words, in the head substrate 293, the plurality of light emitting element groups 295 including a plurality of light emitting elements 2951 are arranged in conformity with the plurality of lenses LS, respectively. Further, collections of a plurality of spots SP formed on the image plane IP by focusing light beams from the light emitting element groups 295 toward the image plane IP by the lenses LS corresponding to the light emitting element groups 295 are defined to be spot groups SG. In other words, a plurality of spot groups SG can be formed in one-to-one correspondence with the plurality of light emitting element groups 295. In each spot group SG, the most upstream spot in the main scanning direction MD and the sub scanning direction SD is particularly defined to be a first spot. The light emitting element 2951 corresponding to the first spot is particularly defined to be a first light emitting element.

FIGS. 10 and 11 show a case where the spots SP are formed with the image plane kept stationary in order to facilitate the understanding of the correspondence relationship of the light emitting element groups 295, the lenses LS and the spot groups SG Accordingly, the formation positions of the spots SP in the spot groups SG are substantially similar to the arranged positions of the light emitting elements 2951 in the light emitting element groups 295. However, as described later, an actual spot forming operation is performed while the image plane IP (surface of the photosensitive drum 21) is conveyed in the sub scanning direction SD. As a result, the spots SP formed by the plurality of light emitting elements 2951 of the head substrate 293 are formed on a straight line substantially parallel to the main scanning direction MD.

Further, spot group rows SGR and spot group columns SGC are defined as shown in the column "On Image Plane" of FIG. 11. Specifically, a plurality of spot groups SG aligned in the main scanning direction MD is defined to be the spot group row SGR. A plurality of spot group rows SGR are arranged at specified spot group row pitches Psgr in the sub scanning direction SD. Further, a plurality of (three in FIG. 11) spot groups SG arranged at the spot group row pitches Psgr in the sub scanning direction SD and at spot group pitches Psg in the main scanning direction MD are defined to be the spot group column SGC. It should be noted that the spot group row pitch Psgr is a distance in the sub scanning direction SD between the geometric centers of gravity of the two spot group rows SGR side by side with the same pitch and that the spot group pitch Psg is a distance in the main scanning direction MD between the geometric centers of gravity of the two spot groups SG side by side with the same pitch.

Lens rows LSR and lens columns LSC are defined as shown in the column of "Lens Array" of FIG. 11. Specifically, a plurality of lenses LS aligned in the longitudinal direction LGD is defined to be the lens row LSR. A plurality of lens rows LSR are arranged at specified lens row pitches Plsr in the width direction LTD. Further, a plurality of (three in FIG. 11) lenses LS arranged at the lens row pitches Plsr in the width direction LTD and at lens pitches Pls in the longitudinal direction LGD are defined to be the lens column LSC. It should be noted that the lens row pitch Plsr is a distance in the width direction LTD between the geometric centers of gravity of the two lens rows LSR side by side with the same pitch and that the lens pitch Pls is a distance in the longitudinal direction LGD between the geometric centers of gravity of the two lenses LS side by side with the same pitch.

Light emitting element group rows 295R and light emitting element group columns 295C are defined as in the column "Head Substrate" of FIG. 11. Specifically, a plurality of light emitting element groups 295 aligned in the longitudinal direction LGD is defined to be the light emitting element group row 295R. A plurality of light emitting element group rows 295R are arranged at specified light emitting element group row pitches Pegr in the width direction LTD. Further, a plurality of (three in FIG. 11) light emitting element groups 295 arranged at the light emitting element group row pitches Pegr in the width direction LTD and at light emitting element group pitches Peg in the longitudinal direction LGD are defined to be the light emitting element group column 295C. It should be noted that the light emitting element group row pitch Pegr is a distance in the width direction LTD between the geometric centers of gravity of the two light emitting element group rows 295R side by side with the same pitch and that the light emitting element group pitch Peg is a distance in the longitudinal direction LGD between the geometric centers of gravity of the two light emitting element groups 295 side by side with the same pitch.

Light emitting element rows 2951R and light emitting element columns 2951C are defined as in the column "Light emitting element Group" of FIG. 11. Specifically, in each light emitting element group 295, a plurality of light emitting elements 2951 aligned in the longitudinal direction LGD is defined to be the light emitting element row 2951R. A plurality of light emitting element rows 2951R are arranged at specified light emitting element row pitches Pelr in the width direction LTD. Further, a plurality of (two in FIG. 11) light emitting elements 2951 arranged at the light emitting element row pitches Pelr in the width direction LTD and at light emitting element pitches Pel in the longitudinal direction LGD are defined to be the light emitting element column 2951C. It should be noted that the light emitting element row pitch Pelr is a distance in the width direction LTD between the geometric centers of gravity of the two light emitting element rows 2951R side by side with the same pitch and that the light emitting element pitch Pel is a distance in the longitudinal direction LGD between the geometric centers of gravity of the two light emitting elements 2951 side by side with the same pitch.

Spot rows SPR and spot columns SPC are defined as shown in the column "Spot Group" of FIG. 11. Specifically, in each spot group SG, a plurality of spots SG aligned in the longitudinal direction LGD is defined to be the spot row SPR. A plurality of spot rows SPR are arranged at specified spot row pitches Pspr in the width direction LTD. Further, a plurality of (two in FIG. 11) spots arranged at the spot row pitches Pspr in the width direction LTD and at spot pitches Psp in the longitudinal direction LGD are defined to be the spot column SPC. It should be noted that the spot row pitch Pspr is a distance in the sub scanning direction SD between the geometric centers of gravity of the two spot rows SPR side by side with the same pitch and that the spot pitch Psp is a distance in the main scanning direction MD between the geometric centers of gravity of the two spots SP side by side with the same pitch.

Figure 12:
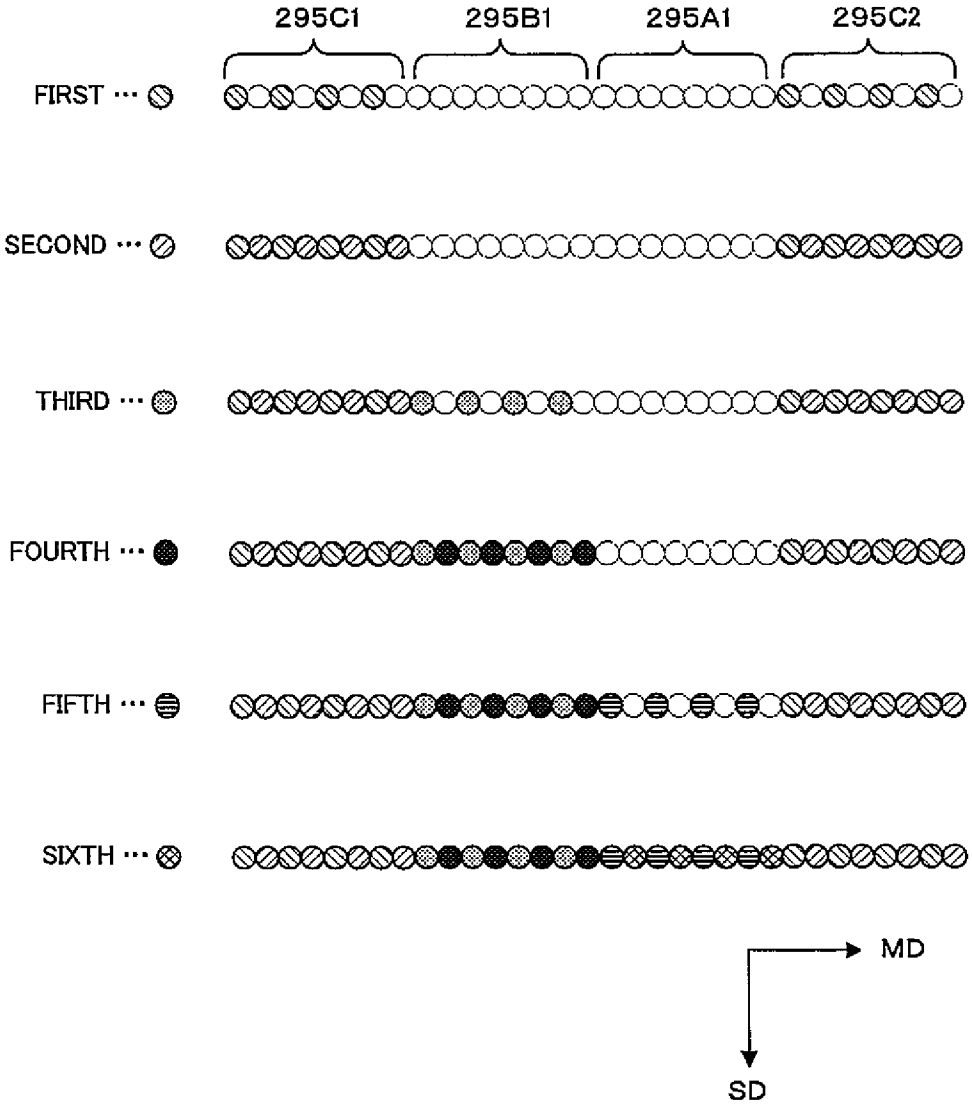
FIG. 12 is a diagram showing a spot forming operation by the above-described line head.

FIG. 12 is a diagram showing a spot forming operation by the above-described line head. The spot forming operation by the line head of this embodiment is described below with reference to FIGS. 2, 7 and 12. In order to facilitate the understanding of the invention, there is described a case where a plurality of spots are aligned on a straight line extending in the main scanning direction MD. In this embodiment, the plurality of spots are formed on the straight line extending in the main scanning direction MD by causing a plurality of light emitting elements to emit lights at specified timings by means of the head control module 54 while the surface of the photosensitive drum 21 (latent image carrier) is conveyed in the sub scanning direction SD.

Specifically, in the line head of this embodiment, six light emitting element rows 2951R are arranged in the width direction LTD corresponding to width-direction positions LTD1 to LTD6 (FIG. 7). Thus, in this embodiment, the light emitting element rows 2951R located at the same width-direction position are driven to emit lights substantially at the same timing, and those located at different width-direction positions are caused to emit lights at mutually different timings. More specifically, the light emitting element rows 2951R are driven to emit lights in an order of the width-direction positions LTD1 to LTD6. By driving the light emitting element rows 2951R to emit lights in the above order while the surface of the photosensitive drum 21 is conveyed in the sub scanning direction SD corresponding to the width direction LTD, the plurality of spots are formed while being aligned on the straight line extending in the main scanning direction MD of this surface.

Such an operation is described with reference to FIGS. 7 and 12. First of all, the light emitting elements 2951 of the light emitting element rows 2951R at the width-direction position LTD1 belonging to the most upstream light emitting element groups 295_C1, 295_C2, 295_C3, . . . in the width direction LTD corresponding to the sub scanning direction SD are driven to emit lights. A plurality of light beams emitted by such a light emitting operation are focused on the photosensitive drum surface in an inverted manner by the lenses LS having the above-mentioned inverting property. In other words, spots are formed at hatched positions of the "first" of FIG. 12. In FIG. 12, white circles represent spots that are not formed yet, but planned to be formed later. In FIG. 12, spots labeled by reference numerals 295_C1, 295_B1, 295_A1 and 295_C2 are those to be formed by the light emitting element groups 295 corresponding to the respective attached reference numerals.

Subsequently, the light emitting elements 2951 of the light emitting element rows 2951R at the width-direction position LTD2 belonging to the same light emitting element groups 295_C1, 295_C2, 295_C3, . . . are driven to emit lights. A plurality of light beams emitted by such a light emitting operation are focused on the photosensitive drum surface in an inverted manner by the lenses LS having the above-mentioned inverting property. In other words, spots are formed at hatched positions of the "second" of FIG. 12. Here, whereas the surface of the photosensitive drum 21 is conveyed in the sub scanning direction SD, the light emitting element rows 2951R are successively driven to emit lights from the downstream ones in the width direction LTD corresponding to the sub scanning direction SD (that is, in the order of the width-direction positions LTD1, LTD2). This is to deal with the inverting property of the lenses LS.

Subsequently, the light emitting elements 2951 of the light emitting element rows 2951R at the width-direction position LTD3 belonging to the second most upstream light emitting element groups 295_B1, 295_B2, 295_B3, . . . in the width direction LTD are driven to emit lights. A plurality of light beams emitted by such a light emitting operation are focused on the photosensitive drum surface in an inverted manner by the lenses LS having the above-mentioned inverting property. In other words, spots are formed at hatched positions of the "third" of FIG. 12.

Subsequently, the light emitting elements 2951 of the light emitting element rows 2951R at the width-direction position LTD4 belonging to the same light emitting element groups 295_B1, 295_B2, 295_B3, . . . are driven to emit lights. A plurality of light beams emitted by such a light emitting operation are focused on the photosensitive drum surface in an inverted manner by the lenses LS having the above-mentioned inverting property. In other words, spots are formed at hatched positions of the "fourth" of FIG. 12.

Subsequently, the light emitting elements 2951 of the light emitting element rows 2951R at the width-direction position LTD5 belonging to the most downstream light emitting element groups 295_A1, 295_A2, 295_A3, . . . in the width direction LTD are driven to emit lights. A plurality of light beams emitted by such a light emitting operation are focused on the photosensitive drum surface in an inverted manner by the lenses LS having the above-mentioned inverting property. In other words, spots are formed at hatched positions of the "fifth" of FIG. 12.

Finally, the light emitting elements 2951 of the light emitting element rows 2951R at the width-direction position LTD6 belonging to the same light emitting element groups 295_A1, 295_A2, 295_A3 . . . are driven to emit lights. A plurality of light beams emitted by such a light emitting operation are focused on the photosensitive drum surface in an inverted manner by the lenses LS having the above-mentioned inverting property In other words, spots are formed at hatched positions of the "sixth" of FIG. 12. By performing the first to sixth light emitting operations in this way, a plurality of spots are formed while being aligned on the straight line extending in the main scanning direction MO.

As described above, in the line head 29 of this embodiment, the plurality of light emitting elements 2951 are arranged on the under surface of the head substrate 293 while being grouped into the light emitting element groups 295 (FIGS. 7 and 9). The light beams emitted from the light emitting elements 2951 pass the head substrate 293 and emerge from the top surface of the head substrate 293. The lenses LS are arranged on the side of the top surface of the head substrate 293 to face the respective light emitting element groups. The respective lenses LS image the light beams emitted from the facing light emitting element groups 295 on the surface of the photosensitive drum 21.

As described above, in this embodiment, the lenses LS are arranged to face the light emitting element groups 295 in a one-to-one correspondence, and the light beams emitted from the light emitting elements 2951 of the respective light emitting element groups 295 are imaged by the lenses LS facing the light emitting element groups 295 to form spots. In other words, the light beam emitted from one light emitting element 2951 is imaged by one lens LS to form a spot in this embodiment, which is different from the above-mentioned related art of forming a spot by superimposing the light beam emitted from one light emitting element 2951 by a plurality of refractive index distribution type lenses. Accordingly, in the line head 29 of this embodiment, the occurrence of a problem that images are split to blur spots due to the deviation of relative positions of the light emitting elements 2951 and the lenses LS is suppressed, wherefore good exposure is possible. Further, since the light beams are imaged without using refractive index distribution type lenses having large optical aberrations in the line head 29 of this embodiment, it is possible to form fine spots and to realize better exposure as compared with the above-mentioned related art.

As, for example, shown in FIG. 7, the plurality of light emitting element groups 295 each as a group of a plurality of light emitting elements 2951 are arranged on the head substrate 293, and the lenses LS are arranged to face the light emitting element groups 295 in a one-to-one correspondence in the lens array 299. In other words, since the lights from the respective light emitting elements 2951 belonging to one light emitting element group 295 are imaged by one lens LS, the aperture of the lens LS is increased. As a result, the quantity of light incident on the lens LS increases and satisfactory spot formation is possible.

Incidentally, in the line head 29 described above, a problem that light quantity varies among the plurality of light emitting elements 2951 occurs in some cases. The cause of such a light quantity variation may be, for example, a variation in light emission frequency among the plurality of light emitting elements 2951. In other words, if the light emission frequency varies among the plurality of light emitting elements 295 1, some of the light emitting elements 2951 reach the ends of their lives relatively early and the light quantities thereof decrease in some cases as compared with the other light emitting elements 2951. Particularly, since organic EL devices have shorter lives than LED devices and the like, such a problem becomes significant when organic EL devices are used as the light emitting elements 2951 as in this embodiment. As a countermeasure, the line head 29 of this embodiment includes optical sensors for detecting the quantities of the light beams emitted from the light emitting elements 2951.

Figure 13:
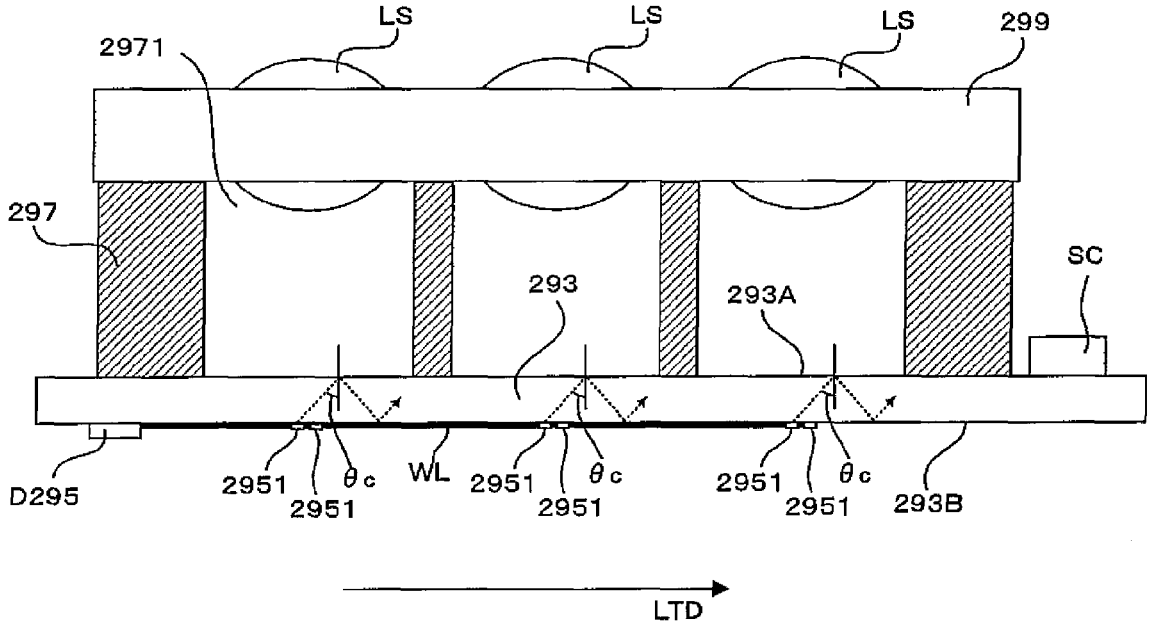
FIGS. 13 and 14 are diagrams showing the arrangement of the optical sensors in the first embodiment.
Figure 14:
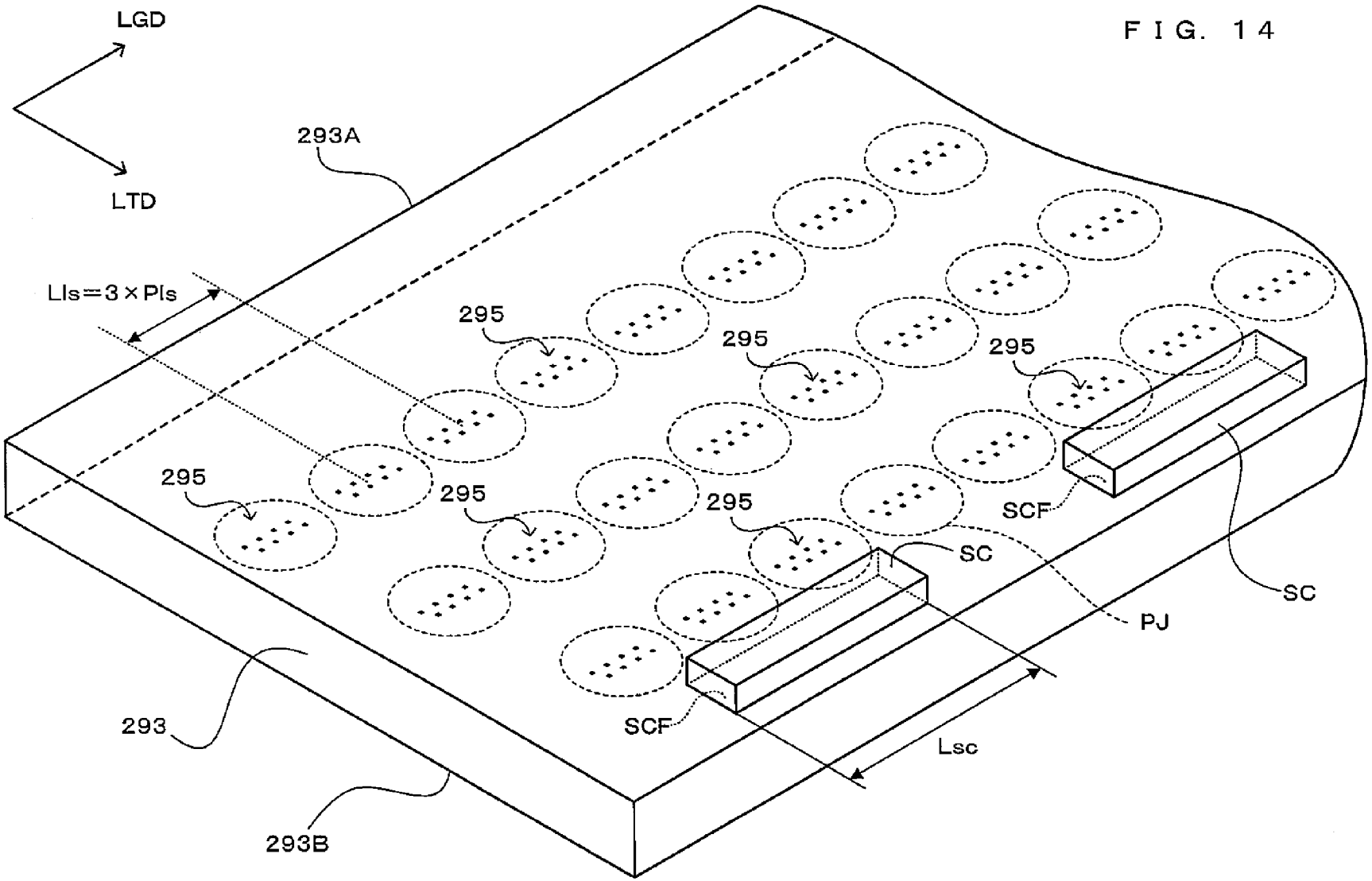

FIGS. 13 and 14 are diagrams showing the arrangement of the optical sensors in the first embodiment. FIG. 13 is a diagram of the line head 29 seen in the longitudinal direction LGD, and FIG. 14 is a perspective view of the head substrate 293. In FIG. 14, broken line circles PJ are the projections of the lenses LS on a head substrate top surface 293A in the optical axis direction. As shown in FIG. 14, a major axis direction of the head substrate 293 is the longitudinal direction LGD corresponding to the main scanning direction MD and a minor axis direction thereof is the width direction LTD corresponding to the sub scanning direction SD. As described above, the plurality of light emitting elements 2951 grouped into the respective light emitting element groups 295 are arranged on the under surface 293B of the head substrate 293. The driving circuits D295 for driving the light emitting elements 2951 and the wiring WL connecting the light emitting elements 2951 and the driving circuits D295 are also arranged on the under surface 293B of the head substrate 293. In FIG. 14, the driving circuits D295 and the wiring WL are not shown.

By being driven by the driving circuits D295, light beams are emitted from the light emitting elements 2951. The light beams emitted from the light emitting elements 2951 in this way pass the head substrate 293 and emerge from the top surface 293A of the head substrate 293. In the above line head 29, the light shielding member 297 is arranged on the side of the top surface of the head substrate 293 in order to prevent the incidence of the light beams emitted from the light emitting elements 2951 on the tenses LS not corresponding thereto, that is, to prevent the occurrence of a so-called crosstalk.

As described above, the head substrate 293 has the top surface 293A and the under surface 293B facing the top surface. In this embodiment, optical sensors SC are arranged on the head substrate top surface 293A out of the two surfaces of the head substrate 293. Particularly, the optical sensors SC are arranged in the following relationship with the plurality of light emitting elements 2951 arranged on the substrate under surface 293B and the light shielding member 297. Specifically, a plurality of optical sensors SC are so arranged on the top surface 293A of the head substrate 293 as to be located at an outer side of the light shielding member 297 in the width direction LTD and adjacent to the light shielding member 297. Further, the plurality of optical sensors SC are arranged at one side (downstream side) in the width direction LTD (that is, in the minor axis direction of the head substrate 293) with respect to the plurality of light emitting elements 2951 formed on the substrate under surface 293B. On the other hand, the driving circuits D295 are arranged at the upstream side of the plurality of light emitting elements 2951 in the width direction LTD, that is, at the upstream side of the element forming area FA in the width direction LTD as shown in FIG. 9. In this way, all of the plurality of optical sensors SC are arranged at the side of the plurality of light emitting elements 2951 opposite to the driving circuits D295 in the width direction LTD in this embodiment. The plurality of optical sensors SC are arranged at regular pitches in the longitudinal direction LGD.

Light receiving surfaces SCF of the plurality of optical sensors SC face the head substrate top surface 293A and are bonded to the head substrate top surface 293A with a clear optical adhesive. Accordingly, light beams propagating from the head substrate top surface 293A toward the light receiving surfaces SCF can be incident on the light receiving surfaces SCF via the optical adhesive. By bonding with the optical adhesive in this way, interfaces between the head substrate top surface 293A and the optical sensors SC can be eliminated to suppress the unnecessary reflection of light beams between the head substrate top surface 293A and the optical sensors SC. As a result, the quantities of light incident on the optical sensors SC increase. The light receiving surfaces SCF of the optical sensors SC have a sensor length Lsc in the longitudinal direction LGD (that is, in the major axis direction of the head substrate 293). The sensor length Lsc is set longer than a pitch Lls between two lenses LS adjacent in the longitudinal direction LGD in each lens row LSR. Since three lens rows LSR are arranged in the width direction LTD in this embodiment, the pitch Lls is equivalent to the threefold of the lens pitch Pls. On the other hand, the width of the light receiving surfaces SCF in the width direction LTD may be larger than, for example, the thickness of the head substrate 293. By so setting the width of the light receiving surfaces SCF, it becomes advantageously possible to cause light beams to be more efficiently incident on the light receiving surfaces SCF. Although not shown, wiring are connected with the respective optical sensors SC and the detection values of the optical sensors SC are outputted to the engine controller EC via such wiring.

As described above, in this embodiment, the light beams emitted from the respective light emitting elements 2951 can be detected by the optical sensors SC on the head substrate top surface 293A. Specifically, not all the light beams emitted from the light emitting elements 2951 emerge from the top surface 293A of the head substrate 293, and some of the light beams are reflected by the top surface 293A to propagate toward the under surface 293B. Further, part of such reflected light beams are reflected again by the under surface 293B to propagate toward the top surface 293A. In this way, some of the light beams emitted from the light emitting elements 2951 propagate in the head substrate 293 to be incident on the optical sensors SC while being repeatedly reflected between the top surface 293A and the under surface 293B of the head substrate 293. Particularly, the light beams (broken line arrows in FIG. 13) incident on the top surface 293A at angles equal to or larger than a critical angle θc are totally reflected by the top surface 293A. Further, in this embodiment, the top surface 293A and the under surface 293B are parallel to each other. Thus, the light beams totally reflected by the top surface 293A propagate in the head substrate 293 while being also totally reflected by the under surface 293B.

In this embodiment, the light beams emitted from the respective light emitting elements 2951 are detected by the optical sensors SC to detect a variation in light quantity among the plurality of light emitting elements 2951, and the driving of the respective light emitting elements 2951 are controlled to eliminate the light quantity variation based on the detection results. This drive control operation described below is performed based on correction coefficients calculated beforehand, for example, when the line head 29 is assembled or shipped. Accordingly, in the following description, the drive control operation is described after a method for calculating the correction coefficient is first described.

As described above, the light quantity of a spot formed at position corresponding to the surface of the photosensitive drum 21 is measured for each light emitting element 2951 by driving the light emitting element 2951 to emit a light beam, for example, when the line head 29 is assembled or shipped. Specifically, the line head 29 is mounted on an inspection jig. A light quantity detector for detecting the light quantity of the light beam emitted from each light emitting element 2951 of the line head 29 at an image plane position corresponding to the surface of the photosensitive drum 21 is arranged on the inspection jig. This light quantity detector may include one detector for detecting the light quantities of the light beams from the respective light emitting elements 2951 while being moved or may include a plurality of detectors arranged in a one-to-one correspondence with the respective light emitting elements 2951. By successively driving the respective light emitting elements 2951 to emit light, values Pgn detected by the light quantity detector of the inspection jig and values Phn (n indicates the n-th light emitting element) detected by the optical sensors SC of the line head 29 are obtained, and correction coefficients Pgn/Phn are calculated for the respective light emitting elements 2951. The correction coefficients Pgn/Phn calculated in this way are stored, for example, in the engine controller EC shown in FIG. 2. Then, as described next, the drive control operation is performed based on the correction coefficients Pgn/Phn.

In the drive control operation, the light quantity variations of the light emitting elements 2951 are first detected. The light quantity variation detection is performed while a normal image forming operation is not performed such as when the image forming apparatus is turned on, before an image forming operation is started or between the successive image forming operations. Specifically, the detection values of the optical sensors SC are measured while the respective light emitting elements 2951 are successively driven to emit light. By multiplying the measurement value by the correction coefficient Pgn/Phn, the light quantity of a spot to be formed on the surface of the photosensitive drum 21 by each light emitting element 2951 is calculated.

When the calculated light quantity varies and a desired light quantity is not realized, the drive of the light emitting element 2951 is so controlled as to obtain the desired light quantity. In other words, by comparing the desired light quantity and the calculated light quantity, a current flowing into the light emitting element 2951 and the like are adjusted so that the calculated light quantity becomes the desired light quantity. By performing such an adjusting operation for all the light emitting elements 2951, the light quantity variation among the plurality of light emitting elements 2951 is suppressed. As a result, good exposure is realized. Information concerning the desired light quantity, a program for performing the drive control operation and the like may be stored, for example, in the engine controller EC beforehand.

As described above, the line head 29 of this embodiment includes the optical sensors SC on the top surface 293A of the head substrate 293. This embodiment can detect the light quantity variation among the plurality of light emitting elements 2951 by detecting light beams emitted from the respective light emitting elements 2951 using the optical sensors SC and is advantageous in realizing good exposure. In other words, as described above, light beams emitted from the respective light emitting elements 2951 are detected by the optical sensors SC and the drive of the light emitting elements 2951 is controlled based on the detection values of the optical sensors SC in this embodiment. As a result, the light quantity variation of spots formed by the respective light emitting elements 2951 is suppressed to realize good exposure. In addition, this embodiment can suppress problems, which could occur upon providing the optical sensors SC in the line head 29 as described above. This point is described.

Specifically, the plurality of light emitting elements 2951 and the wiring WL connected with the light emitting elements 2951 are arranged on the under surface 293B of the head substrate 293. Accordingly, in the case of arranging the optical sensors SC on the head substrate under surface 293B, the light emitting elements 2951 and the optical sensors SC may possibly come into contact with each other. Alternatively, if the optical sensors SC are arranged on the head substrate under surface 293B, the wiring WL and the optical sensors SC may possibly interfere with each other by the contact of the wiring WL and the optical sensors SC or by the action of electrical signals given to the wiring WL on the optical sensors SC as noise. In the case of arranging the optical sensors SC on the under surface 293B of the head substrate 293, a problem that the light emitting elements 2951 or the wiring WL interfere with the optical sensors SC could occur in this way. As a countermeasure, the optical sensors SC are arranged on the top surface 293A of the head substrate 293 in this embodiment. Thus, this embodiment is advantageous in being able to detect the light quantity variation among the plurality of light emitting elements 2951 to realize good exposure while suppressing the occurrence of the problem that the optical sensors SC interfere with the members (light emitting elements 2951, wiring WL) arranged on the head substrate under surface 293B.

Further, in such a construction, the light receiving surfaces SCF of the optical sensors SC can be large. Specifically, as described above, the light emitting elements 2951, the wiring WL and the driving circuits D295 (hereinafter, "light emitting elements 2951 and the like") are formed on the head substrate under surface 293B. On the contrary, the light emitting elements 2951 and the like are not arranged on the head substrate top surface 293A where the optical sensors SC are arranged. Accordingly, the light receiving surfaces SCF can be enlarged to enable high-accuracy light quantity detection.

The construction of arranging the optical sensors SC on the head substrate top surface 293A is also advantageous in the following point. Specifically, as can be understood from FIG. 13, etc., in the case of arranging the optical sensors SC on the head substrate under surface 293B (i.e. surface where the light emitting elements 2951 and the like are formed), lights detectable by the optical sensors SC are only those reflected at least once by the head substrate top surface 293A. On the contrary, in the case of arranging the optical sensors SC on the head substrate top surface 293A (i.e. surface facing the one where the light emitting elements 2951 and the like are formed), the optical sensors SC can detect direct lights from the light emitting elements 2951. Such direct lights have higher intensities than the reflected lights attenuated through reflections. Therefore, light quantity detection of higher accuracy is possible in this embodiment.

As described above, since high-accuracy light quantity detection is possible according to this embodiment, even light beams having small light quantities can be detected with high detection accuracy. As a result, a high S/N ratio is realized.

Second Embodiment

Figure 15:
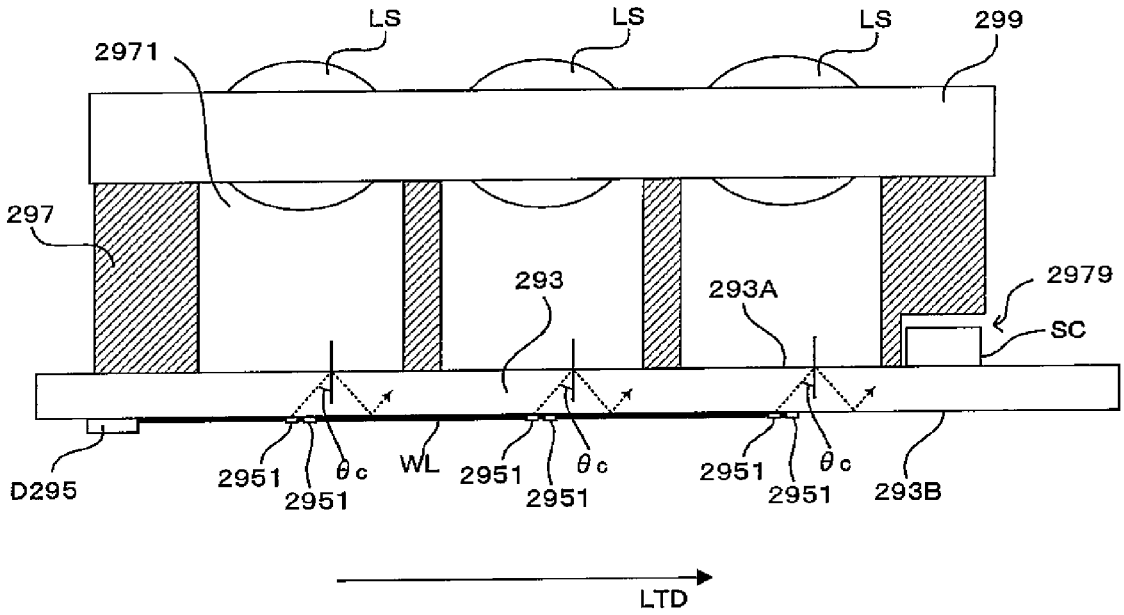
FIG. 15 is a diagram showing the arrangement of an optical sensor in a second embodiment of the line head according to the invention.
Figure 16:
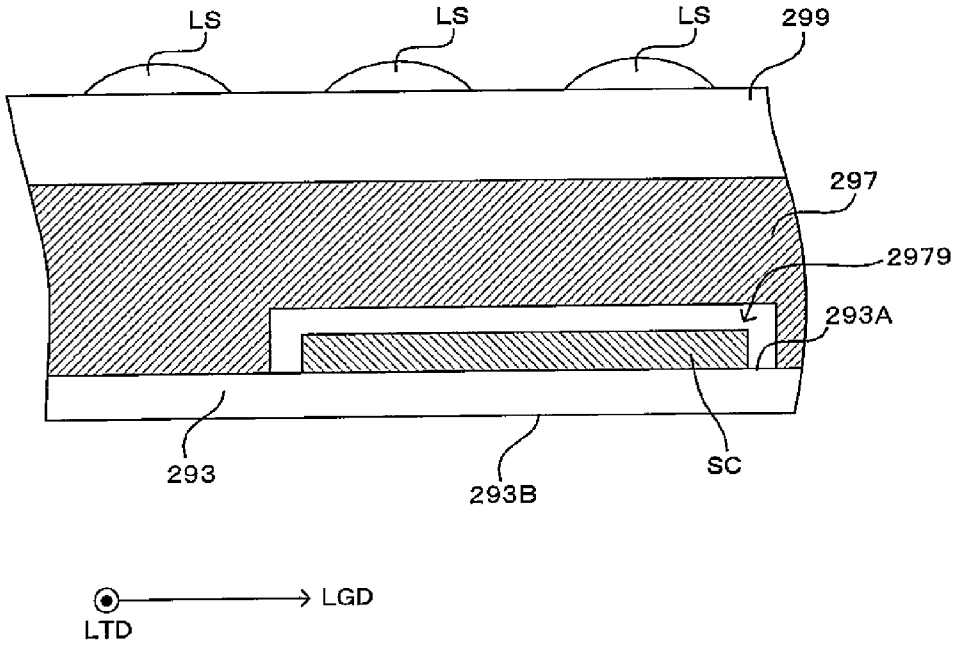
FIG. 16 is a side view of FIG. 15 when seen in the width direction.

FIG. 15 is a diagram showing the arrangement of an optical sensor in a second embodiment of the line head according to the invention. FIG. 16 is a side view of FIG. 15 when seen in the width direction. In FIG. 16, the members arranged on the head substrate under surface 293B are not shown. In the following description of the second embodiment, points of difference from the first embodiment are mainly described, whereas common parts are not described by being identified by corresponding reference numerals. In the second embodiment as well, the optical sensors SC are arranged on the head substrate top surface 293A to suppress the problem of the interference of the optical sensors SC and the members arranged on the head substrate under surface 293B as described above.

On the other hand, in the second embodiment, the arrangement relationship of the light shielding member 297 and the optical sensors SC differs from the one in the first embodiment. Specifically, in the second embodiment, sensor arrangement spaces 2979 are provided at an end of the light shielding member in the width direction LTD. The arrangement spaces 2979 have a shape of a substantially rectangular parallelepiped with specified dimensions in the width direction LTD, in the longitudinal direction LGD and in the vertical direction, and make openings in the outer side of the light shielding member 297 in the width direction LTD. In the second embodiment, the optical sensors SC are arranged in the sensor arrangement spaces 2979 thus formed in the light shielding member 297. As a result, as compared with the case of the first embodiment, the optical sensors SC can be arranged closer to the light emitting elements 2951. This results in an improvement in light beam detection accuracy by the optical sensors SC and the line head 29 of the second embodiment is preferable.

Specifically, parts of the light shielding member 297 facing the head substrate 293 are cut out to form the sensor arrangement spaces 2979 (first space) between the light shielding member 297 and the head substrate 293. The optical sensors SC are arranged in the sensor arrangement spaces (first space), and the optical sensors SC and the light shielding member 297 overlap in the width direction LTD (minor axis direction). Accordingly, the optical sensors SC can be arranged closer to the light emitting elements 2951 to increase the light quantities detected by the optical sensors SC. As a result, the detection accuracy of the optical sensors SC is improved.

Light beams emitted from the light emitting elements 2951 reach the optical sensors SC after propagating in the substrate while being repeatedly reflected between the top surface 293A and the under surface 293B of the head substrate 293. On the other hand, as described above, the wiring WL are arranged on the under surface of the head substrate 293. As a result, there are cases where the reflection of the light beams propagating from the light emitting elements 2951 toward the optical sensors SC is disturbed by the wiring WL on the under surface 293B of the head substrate 293 to reduce the light quantities of the light beams reaching the optical sensors SC. Further, in the above line head 29, an adhesive layer is provided upon arranging the wiring WL on the head substrate under surface 293B in some cases. In such cases, the wiring WL are arranged on the head substrate under surface 293B using the adhesive layer. Such an adhesive layer could also become the cause of disturbing the reflection of the light beams. There are also cases where parts of function films constituting the light emitting elements 2951 are in contact with the head substrate under surface 293B. In such cases, such function films could also become the cause of disturbing the reflection of the light beams. Accordingly, the line head 29 may be constructed as in the following third embodiment.

Third Embodiment

Figure 17:
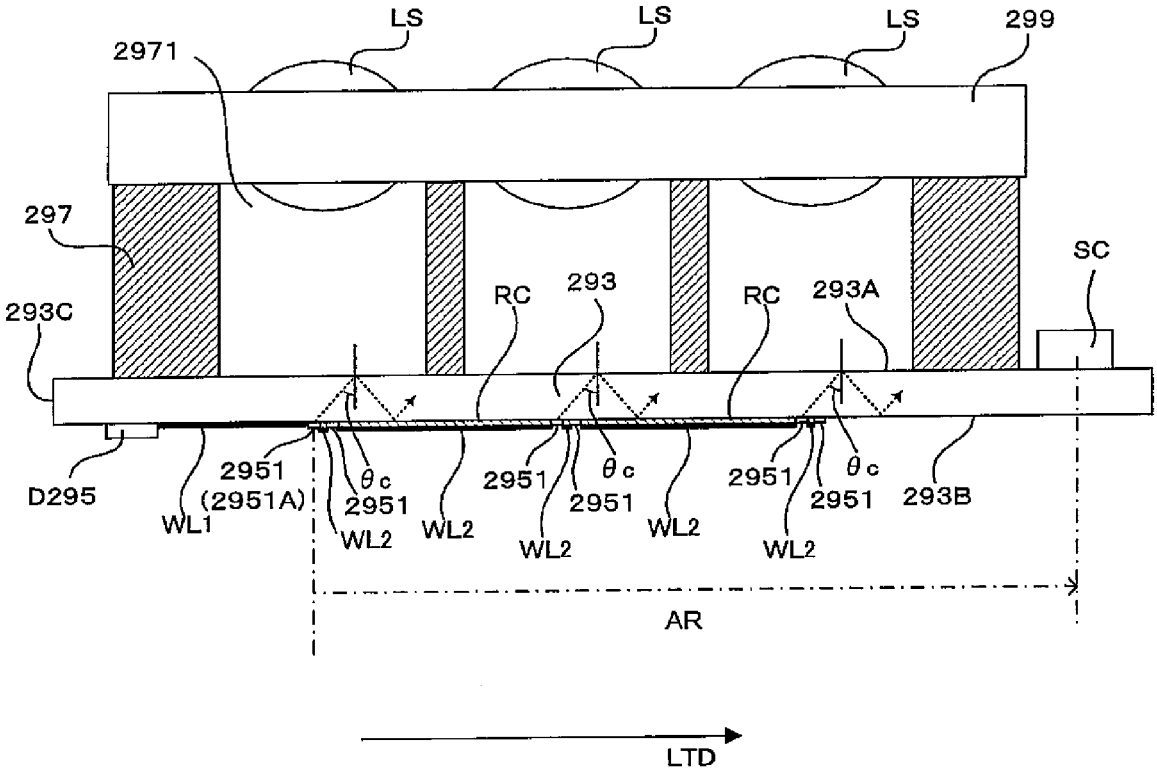
FIG. 17 is a diagram showing a third embodiment of the line head according to the invention.

FIG. 17 is a diagram showing a third embodiment of the line head according to the invention. In the following description of the third embodiment, points of difference from the above embodiments are mainly described, whereas common parts are not described by being identified by corresponding reference numerals. In the third embodiment as well, the optical sensors SC are arranged on the head substrate top surface 293A to suppress the problem of the interference of the optical sensors SC and the members arranged on the head substrate under surface 293B as described above.

On the other hand, in the third embodiment, the arrangement mode of the wiring WL differs from those of the above embodiments. Specifically, in the third embodiment, reflection films RC are provided for wiring WL2 arranged in an area of the head substrate under surface 293B extending from the respective light emitting elements 2951 toward the optical sensors SC. For example, in FIG. 17, the wiring WL2 are arranged in an area AR extending from the light emitting elements 2951A to the optical sensor SC, and the reflection films RC are provided for these wiring WL2. The reflection films RC are formed such that the upper surfaces thereof are in close contact with the head substrate under surface 293B. On the other hand, the wiring WL2 are arranged on the lower surfaces of the reflection films RC. Accordingly, light beams incident on the head substrate under surface 293B from the interior of the substrate are reflected by the reflection films RC. Thus, the reflection by the head substrate under surface 293B is not disturbed by the wiring WL2 and the light beams can reach the optical sensors SC. Further, the adhesive layer and/or the function films described above may be, for example, formed below the reflection films RC. This can suppress the problem that the reflection of the light beams is disturbed by the adhesive layer and the function films.

The reflection films RC can be made of metal such as aluminum. Here, what is problematic is a short circuit of the wiring WL also made of metal and the reflection films RC. An insulation film as described below may be provided to deal with such a problem.

Figure 18:
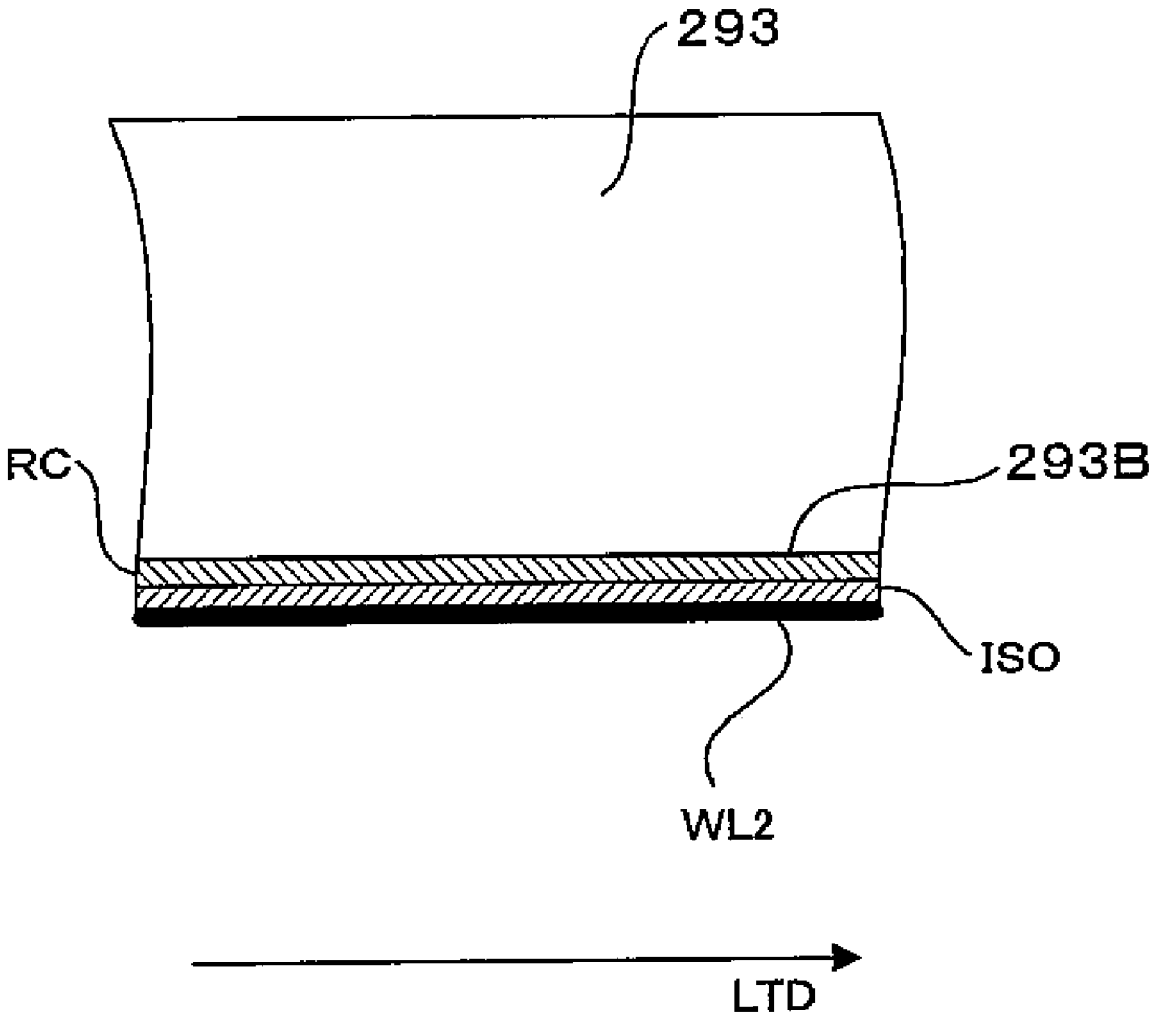
FIG. 18 is a partial enlarged diagram of the head substrate under surface.

FIG. 18 is a partial enlarged diagram of the head substrate under surface. As shown in FIG. 18, the reflection film RC is formed such that the upper surface thereof is in close contact with the head substrate under surface 293B. Further, the wiring WL2 is provided on the lower surface of the reflection film RC. Furthermore, in the construction shown in FIG. 18, an insulation film ISO is provided between the reflection film RC and the wiring WL2. A short circuit between the reflection film RC and the wiring WL is prevented by such an insulation film ISO. For example, silicon dioxide ($SiO_2$) can be used as the material of the insulation film ISO.

Fourth Embodiment

Figure 19:
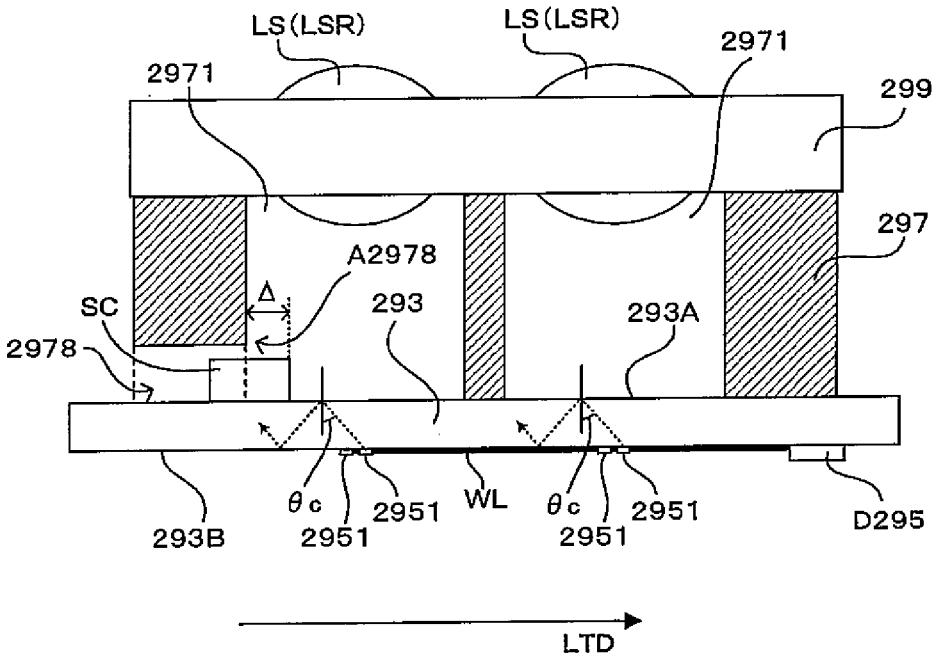
FIG. 19 is a partial sectional view of a line head according to a fourth embodiment along the width direction.
Figure 20:
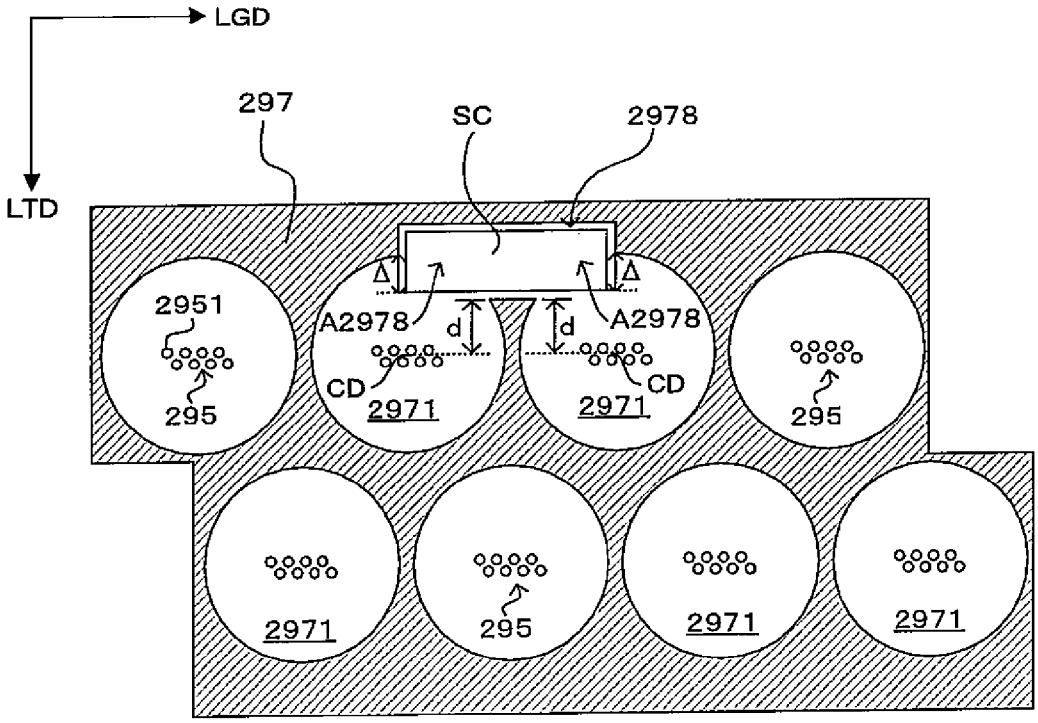
FIG. 20 is a plan view of the line head according to the fourth embodiment when seen in a direction perpendicular to the width direction and the longitudinal direction.

FIG. 19 is a partial sectional view of a line head according to a fourth embodiment along the width direction LTD. FIG. 20 is a plan view of the line head according to the fourth embodiment when seen in a direction perpendicular to the width direction LTD and the longitudinal direction LGD. In the following description, points of difference from the above embodiments are mainly described, whereas common parts are not described by being identified by corresponding reference numerals. As shown in FIGS. 19 and 20, two lens rows LSR are arranged at mutually different positions in the width direction LTD.

In this embodiment, parts of the light shielding member 297 facing the line head 293 are cut out to form sensor arrangement spaces 2978 (second space) which open into the light guide holes 2971 between the light shielding member 297 and the head substrate 293. As shown in FIG. 19, the sensor arrangement space 2978 is provided at a side opposite to the driving circuits D295 in the width direction LTD. The optical sensor SC is arranged in this sensor arrangement space 2978. At this time, one end of the optical sensor SC is located in the sensor arrangement space 2978, whereas the other end (part) thereof projects into the light guide holes 2971 through openings A2978 of the sensor arrangement space 2978. As a result, the optical sensor SC overlaps the light guide holes 2971 only by an overlapping width Δ in the width direction LTD.

As shown in FIG. 20, the sensor arrangement space 2978 (second space) communicates with the two light guide holes 2971 juxtaposed in the longitudinal direction LGD. The optical sensor SC arranged in this sensor arrangement space 2978 overlaps the two light guide holes 2971 communicating with each other. In other words, the optical sensor SC is so arranged as to extend across the two light guide holes 2971. At this time, by properly setting distances between the centers of the lenses LS and the sensor arrangement space 2978, crosstalk via the sensor arrangement space 2978 (that is, crosstalk caused by the incidence of light beams from the light emitting elements 2951 on the adjacent lenses LS through the sensor arrangement space 2978) can be suppressed. Specifically, in FIG. 20, a shortest distance d from the lens center in the width direction LTD to the sensor arrangement space 2978 is set equal to or longer than a specified distance.

As described above, the optical sensor SC is arranged to overlap the light guide holes 2971. Accordingly, the optical sensor SC can be arranged further closer to the light emitting elements 2951, thereby increasing the light quantity detected by the optical sensor SC. As a result, the light quantity can be detected with high detection accuracy by the optical sensor SC.

Further, the sensor arrangement space 2978 (second space) communicates with a plurality of light guide holes 2971, and the optical sensor SC overlaps the plurality of light guide holes 2971 communicating with each other. Thus, the light quantity can be detected with higher accuracy by the optical sensor SC.

Miscellaneous

As described above, in the above embodiments, the head substrate 293 corresponds to a "substrate" of the invention; the under surface 293B of the head substrate 293 to a "first surface" of the invention; and the top surface 293A of the head substrate 293 to a "second surface" of the invention. Further, in the above embodiments, the lenses LS correspond to "imaging lenses" of the invention; the light receiving surface SCF of the optical sensor SC to a "light receiving region" of the invention; the photosensitive drum 21 to a "latent image carrier" of the invention; the sub scanning direction SD to a "moving direction" of the latent image carrier surface; and the surface of the photosensitive drum 21 to an "image plane" of the invention. Furthermore, the sensor arrangement space 2979 corresponds to a "first space" of the invention, and the sensor arrangement space 2978 to a "second space" of the invention.

The invention is not limited to the above embodiments and various changes other than those mentioned above can be made without departing from the gist thereof. Specifically, as shown in FIGS. 13 to 17, the optical sensors SC are arranged at one side in the width direction LTD with respect to the plurality of light emitting elements 2951 in the above embodiments. But, the optical sensors SC may be arranged at one side in the longitudinal direction LGD with respect to the plurality of light emitting elements 2951, for example. However, the construction of the above embodiments is preferable in the following point. Specifically, distances from the light emitting elements 2951 to the optical sensors SC can be relatively shortened and the light quantities reaching the optical sensors SC can be increased by arranging the optical sensors SC at the one side in the width direction LTD with respect to the plurality of light emitting elements 2951. As a result, the light beam detection accuracy is improved and good exposure can be realized, and hence, the above embodiments are preferable.

Further, the plurality of optical sensors SC are arranged at one side in the width direction LTD with respect to the plurality of light emitting elements 2951 in the above embodiments as shown in FIGS. 13 to 17. But, such a construction is not essential to the invention. However, the above embodiments are preferable in the following point. Specifically, in the case of construction as in the above embodiments, light beams from the light emitting elements 2951 can be detected by the plurality of optical sensors SC to improve the light beam detection accuracy. In such a construction, all the optical sensors SC are arranged only at the one side in the width direction LTD with respect to the plurality of light emitting elements 2951. Thus, it is not necessary to wire the optical sensors SC at both sides in the width direction LTD and the wiring leading to the optical sensors SC can be simplified, and hence, the above embodiments are preferable.

Although the plurality of optical sensors SC are arranged at regular pitches in the major axis direction (that is, longitudinal direction LGD) in the above embodiments as shown in FIGS. 13 to 17, it is not essential to the invention that the plurality of optical sensors SC are arranged at regular pitches. However, the above embodiments are preferable in the following point. Specifically, if the optical sensors SC are irregularly present, detection accuracy for the light quantities of the light emitting elements 2951 in an area where the optical sensors SC are densely arranged is improved, but the one for the light quantities of the light emitting elements 2951 in an area where the optical sensors SC are sparsely arranged decreases. On the contrary, in the case of arranging the plurality of optical sensors SC at regular pitches, the light beams from the respective light emitting elements 2951 can be detected with stable detection accuracy, and hence, the above embodiments are preferable.

Figure 25:
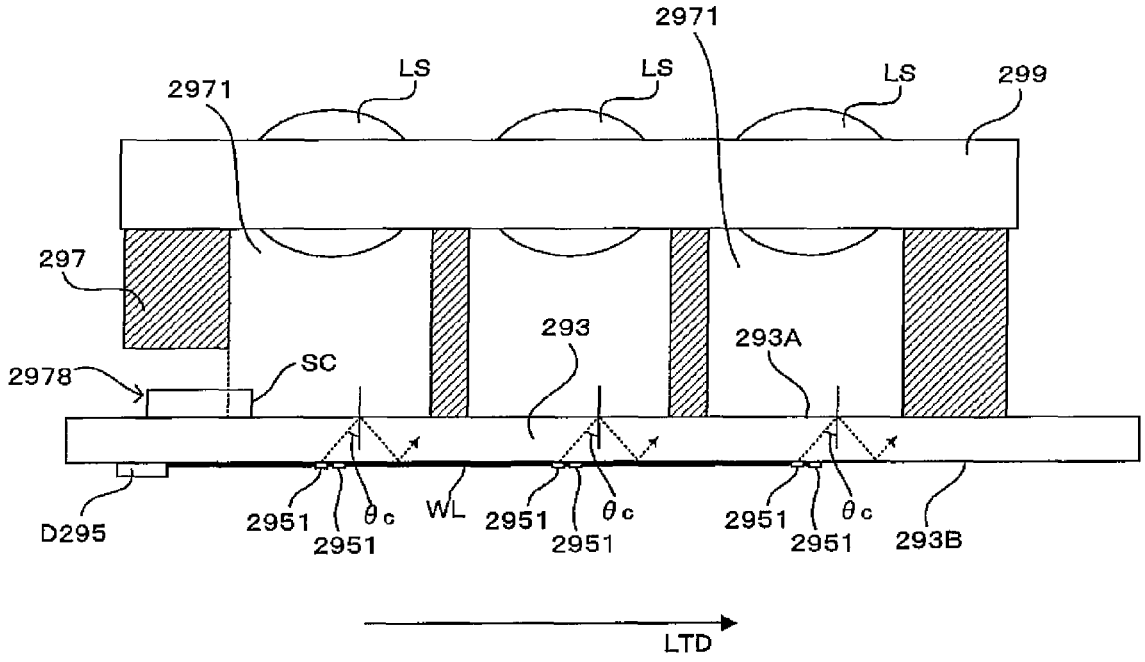
FIG. 25 is a partial sectional view showing a modification of the arrangement mode of the optical sensors.

Although the electronic components (driving circuits D295) connected with the wiring WL are arranged in the area of the under surface 293B of the head substrate 293 at the side opposite to the optical sensors SC with respect to the plurality of light emitting elements 2951 in the above embodiments as shown in FIGS. 13 to 17, such a construction is not essential to the invention. The optical sensors SC and the electronic components (driving circuits D295) may be arranged, for example, in areas at the same side (as shown in FIG. 25 to be described later). However, the driving circuits D295 have large electromagnetic radiation. Accordingly, in the case of arranging the driving circuits D295 close to the optical sensors SC, the optical sensors SC erroneously detect light beams in some cases. Upon suppressing such interference of the driving circuits D295 and the optical sensors SC, it is preferable to maximally separate the driving circuits D295 and the optical sensors SC. Thus, the above construction of arranging the electronic components (driving circuits D295)

connected with the wiring WL in the area at the side opposite to the optical sensors SC is preferable since the interference of the driving circuits D295 connected with the wiring WL and the optical sensors SC can be suppressed.

As shown in FIG. 14, in the above embodiments, the sensor length Lsc (corresponding to a "length of the light receiving region in the major axis direction" of the invention) is set longer than the pitch Lls between two lenses LS adjacent in the longitudinal direction LGD in the respective lens rows LSR. But, such setting of the sensor length Lsc is not essential to the invention. However, in the above construction of arranging the plurality of lenses LS to form the lens rows LSR, in which the lenses LS are arranged in the longitudinal direction LGD, it is preferable in the following point to set the sensor length Lsc as above. Specifically, in the above line head 29, the light emitting element groups 295 are arranged to face the respective lenses LS. As a result, in the line head 29 formed with the above lens rows LSR, the light emitting element groups 295 are also arranged in the longitudinal direction LGD. Light beams from the respective light emitting element groups 295 arranged in the longitudinal direction LGD in this way are incident on the light receiving surfaces SCF of the optical sensors SC. Accordingly, if the length of the light receiving surfaces SCF in the longitudinal direction LGD is shorter than a pitch between two light emitting element groups 295 arranged in the longitudinal direction LGD (that is, pitch between two lenses LS adjacent in the longitudinal direction LGD), distances to the light receiving surfaces SCF vary between these two light emitting element groups 295. As a result, there have been cases where the optical sensors SC could not satisfactorily detect the light beams. On the contrary, the construction of setting the sensor length Lsc longer than the pitch Lls between two lenses LS adjacent in the longitudinal direction LGD in the respective lens rows LSR can suppress the above variation in the distance to the light receiving surface SCF between the two light emitting element groups 295. As a result, good light beam detection can be realized.

Although the top surface 293A and the under surface 293B of the head substrate 293 are parallel to each other in the above embodiments, it is not essential to the invention that the top surface 293A and the under surface 293B are parallel to each other. However, the above embodiments are preferable in the following point. Specifically, in the construction as in the above embodiments, light beams can propagate in the head substrate 293 while being repeatedly reflected between the top surface 293A and the under surface 293B as described above. Accordingly, the light beams from the light emitting elements 2951 can be efficiently introduced to the optical sensors SC. As a result, more lights are incident on the optical sensors SC to improve the light beam detection accuracy.

Figure 21:
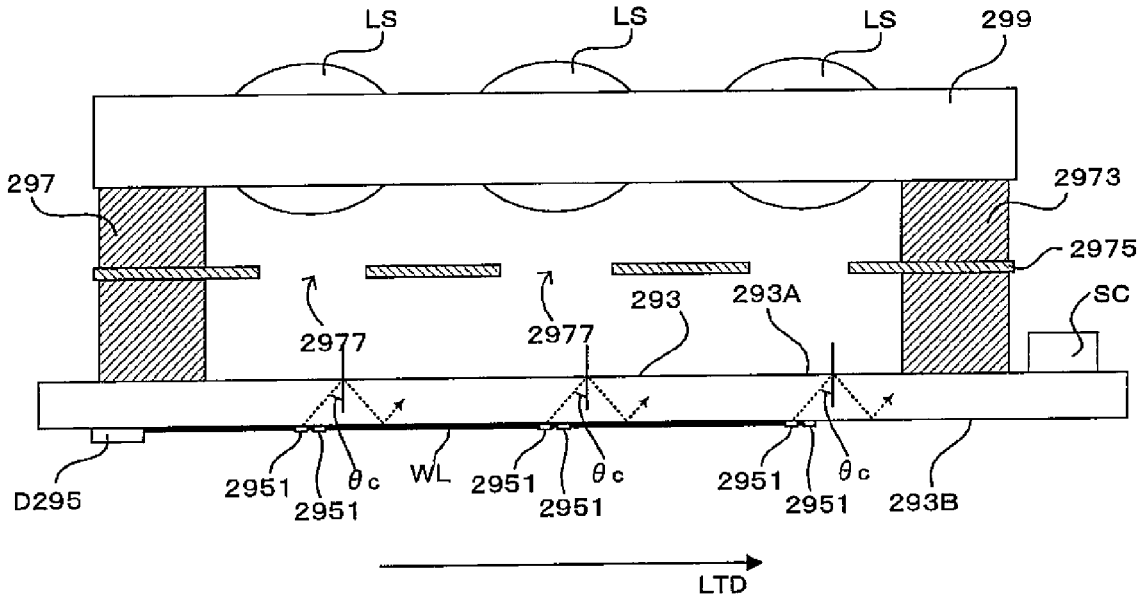
FIG. 21 is a diagram showing another construction of the light shielding member.
Figure 22:
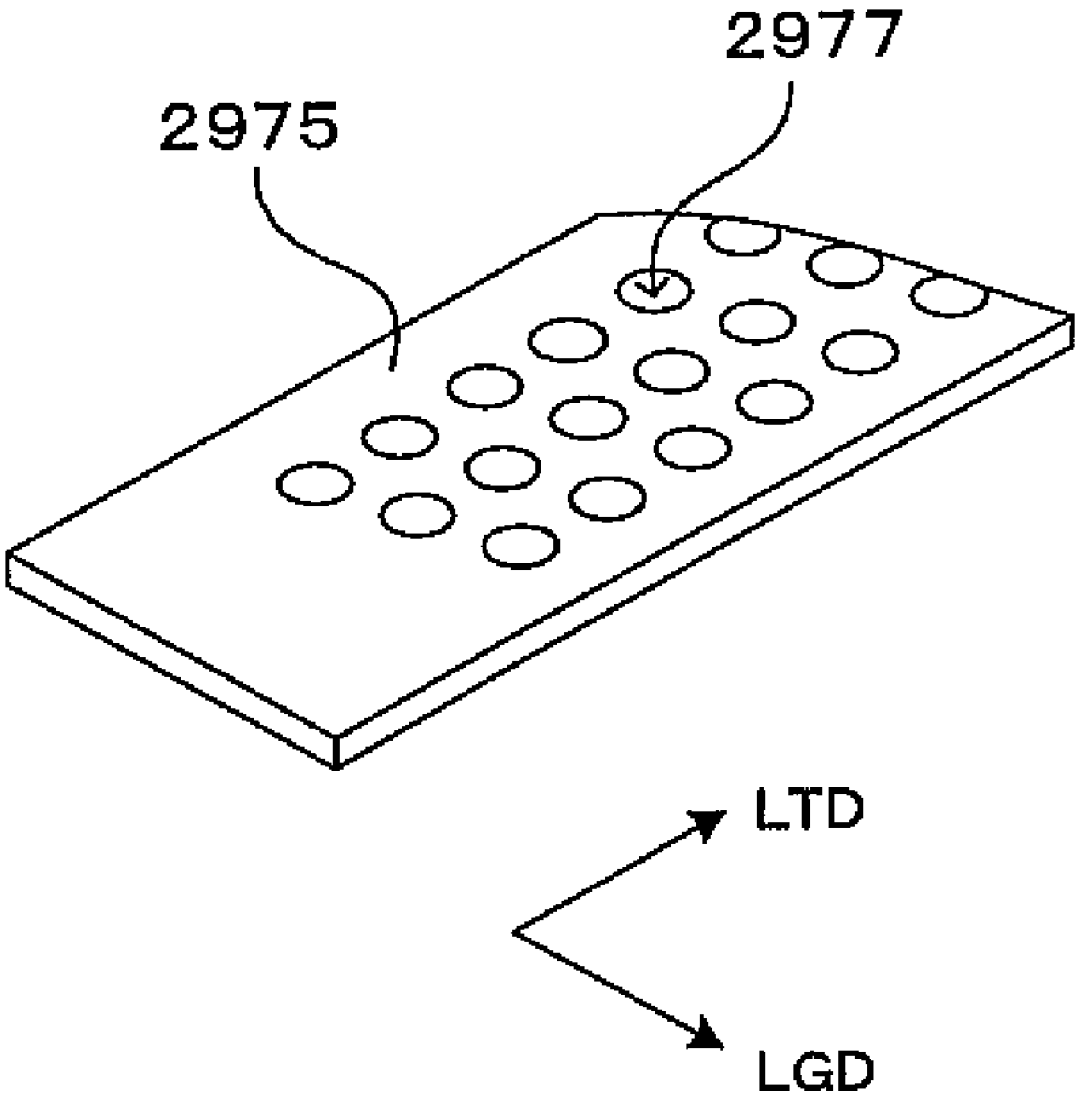
FIG. 22 is a perspective view showing a light shielding plate of the light shielding member of FIG. 21.

The light shielding member 297 is also not limited to the above construction. For example, the light shielding member 297 may be constructed as follows. FIG. 21 is a diagram showing another construction of the light shielding member. FIG. 22 is a perspective view showing a light shielding plate of the light shielding member 297 of FIG. 21. FIG. 21 corresponds to a case where a line head 29 is seen in the longitudinal direction LGD. Since the line head 29 shown in FIGS. 21 and 22 differs from the line heads 29 of the above embodiments only in the light shielding member 297, points of difference are mainly described and other parts are not described by being identified by corresponding reference numerals below.

In the embodiment shown in FIGS. 21 and 22, the light shielding member 297 includes a light shielding plate 2975 and plate supporting members 2973 supporting the light shielding plate 2975. The light shielding plate 2975 is supported such that a minor axis of the light shielding plate 2975 corresponds to the width direction LTD and a major axis thereof to the longitudinal direction LGD. The light shielding plate 2975 is located between the lens array 299 and the head substrate 293 and supported to face the lens array 299 and the head substrate 293. The light shielding plate 2975 is perforated with openings 2977 corresponding to the respective lenses LS (or the respective light emitting element groups 295). Accordingly, out of light beams emitted from the light emitting element group 295, only those having passed through the opening 2977 corresponding to the light emitting element group 295 are incident on the lens LS. In this way, the light shielding plate 2975 functions to adjust the light quantity of the light beams incident on the lens LS. The light shielding member 297 may also be constructed as follows.

Figure 23:
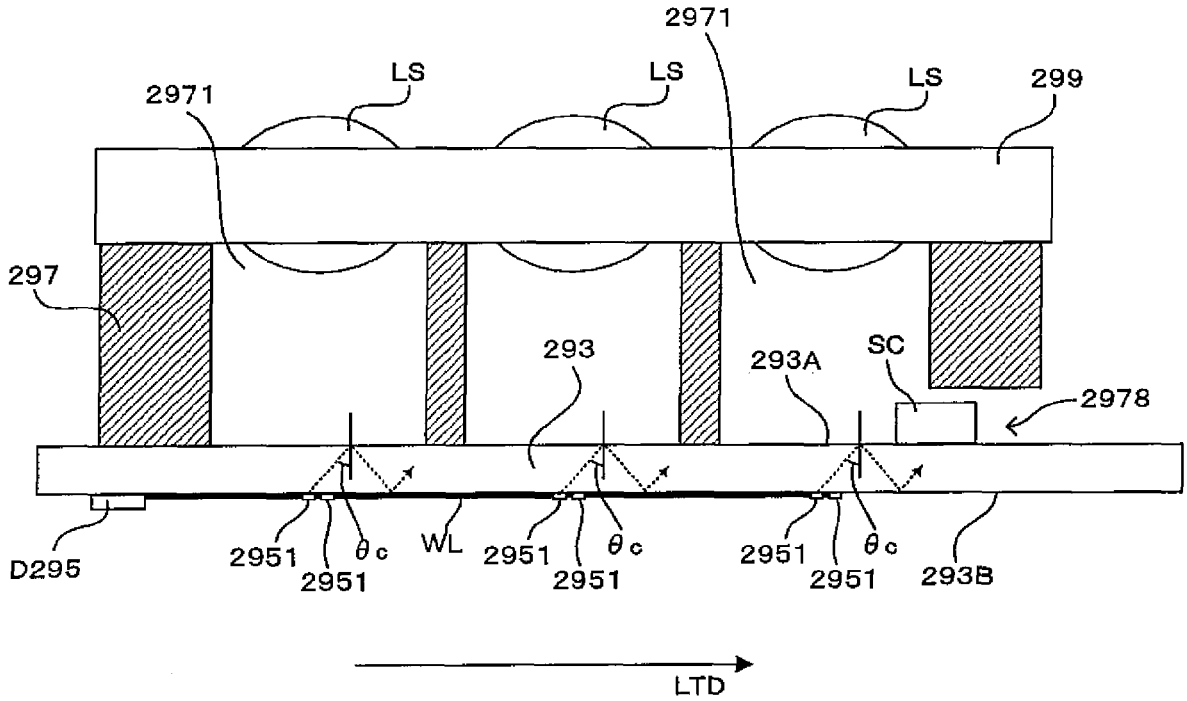
FIG. 23 is a diagram showing still another construction of the light shielding member.

FIG. 23 is a diagram showing still another construction of the light shielding member. In a light shielding member 297 shown in FIG. 23, through holes 2978 are formed to penetrate one end of the light shielding member in the width direction LTD. This through holes 2978 are formed to penetrate from the outer side of the light shielding member 297 toward the light guide holes 2971. The optical sensors SC are arranged in such through holes 2978. At this time, the optical sensors SC are so arranged as to be partly located in the light guide holes 2971. Accordingly, the optical sensors SC can directly detect the light beams passing through the light guide holes 2971. As a result, the light beam detection accuracy is improved, and hence, the line head 29 including the light shielding member 297 of FIG. 23 is preferable.

Specifically, in the example shown in FIG. 23 as well, parts of the light shielding member 297 facing the head substrate 293 are cut out to form sensor arrangement spaces 2978 (second space) which open into the light guide holes 2971 between the light shielding member 297 and the head substrate 293. The optical sensors SC are arranged in the sensor arrangement spaces 2978. The optical sensors SC partly project into the light guide holes 2971 through openings of the sensor arrangement spaces 2978 and overlap the light guide holes 2971. Accordingly, the optical sensors SC can be arranged further closer to the light emitting elements 2951 and the light quantities detected by the optical sensors SC can be increased. As a result, the light quantities can be detected with high detection accuracy by the optical sensors SC.

Figure 24:
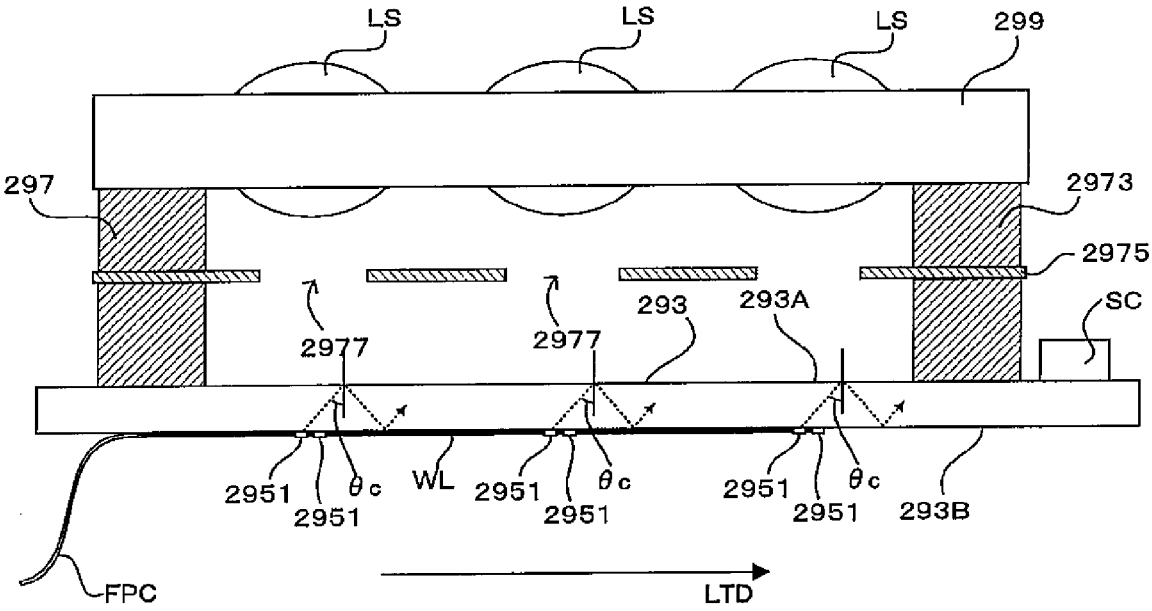
FIG. 24 is a diagram showing an exemplary arrangement mode of the flexible printed circuit board.

Although the driving circuits D295 are arranged on the under surface 293B of the head substrate 293 in the above embodiments, the arrangement positions of the driving circuits D295 are not limited to those on the under surface 293B of the head substrate 293. For example, a flexible printed circuit board FPC may be provided on the under surface of the head substrate 293 unless the driving circuits D295 are arranged on the under surface of the head substrate 293. FIG. 24 is a diagram showing an exemplary arrangement mode of the flexible printed circuit board FPC. Specifically, as shown in FIG. 24, the flexible printed circuit board FPC may be connected with the wiring WL leading to the light emitting elements 2951 and drive signals may be given to the light emitting elements 2951 via the flexible printed circuit board FPC. In this case, the flexible printed circuit board FPC (electronic component) may be arranged in an area of the under surface 293B of the head substrate 293 at the side opposite to the optical sensors SC with respect to the plurality of light emitting elements 2951. This is because such a construction can suppress the interference between the flexible printed circuit board FPC connected with the wiring WL and the optical sensors SC and is preferable.

Further, as shown in FIG. 25, the optical sensors SC may be arranged right above the driving circuits D295 (in other words, so that the optical sensors SC and the driving circuits D295 overlap in the width direction LTD). FIG. 25 is a partial sectional view showing a modification of the arrangement mode of the optical sensors. As shown in FIG. 25, the wiring WL are drawn to the left side of FIG. 25 from the plurality of light emitting elements 2951, and the optical sensors SC are also arranged at the left side. In such a construction, the wiring WL connected with the light emitting elements 2951 and wiring (not shown) connected with the optical sensors SC can be collectively arranged at the same side of the head substrate 293, and hence, the wiring can be simplified.

Figure 26:
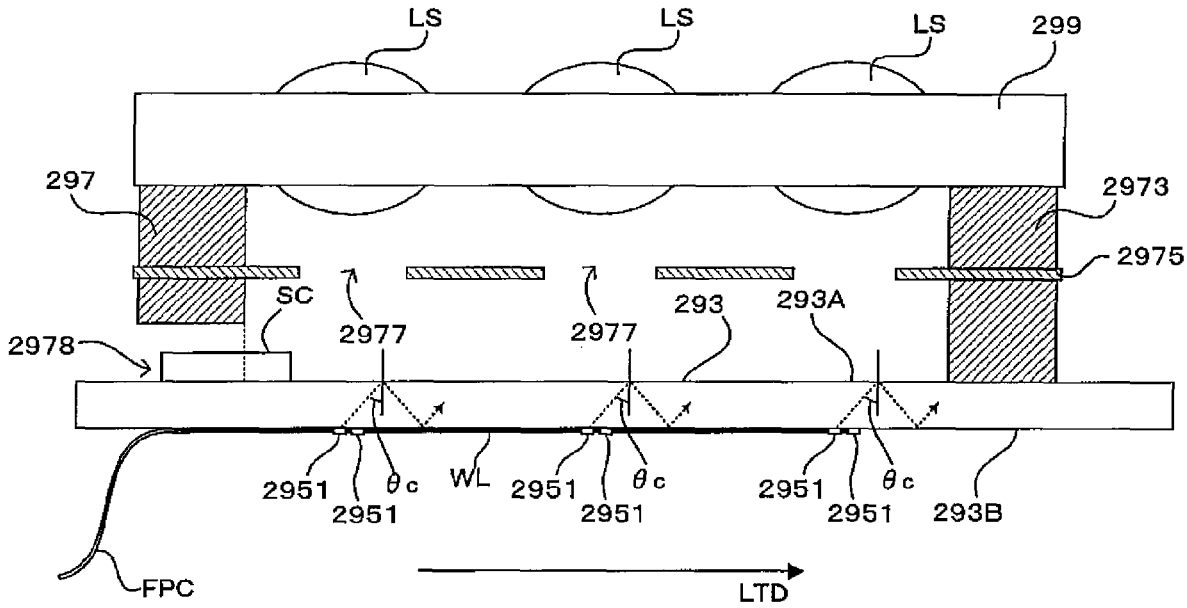
FIG. 26 is a partial sectional view showing a modification of the arrangement mode of the flexible printed circuit board.

The flexible printed circuit board FPC may be arranged as follows for the above construction in which the wiring WL of the light emitting elements 2951 and those of the optical sensors SC are collectively arranged at the same side. FIG. 26 is a partial sectional view showing a modification of the arrangement mode of the flexible printed circuit board FPC. In this modification, the flexible printed circuit board FPC is connected with the wiring WL drawn to the left side of FIG. 26 from the light emitting elements 2951. Accordingly, the flexible printed circuit board FPC and the optical sensors SC are arranged at the same side of the head substrate 293 in the width direction LTD. Drive signals are given to the light emitting elements 2951 via the thus arranged flexible printed circuit board FPC.

Figure 27:
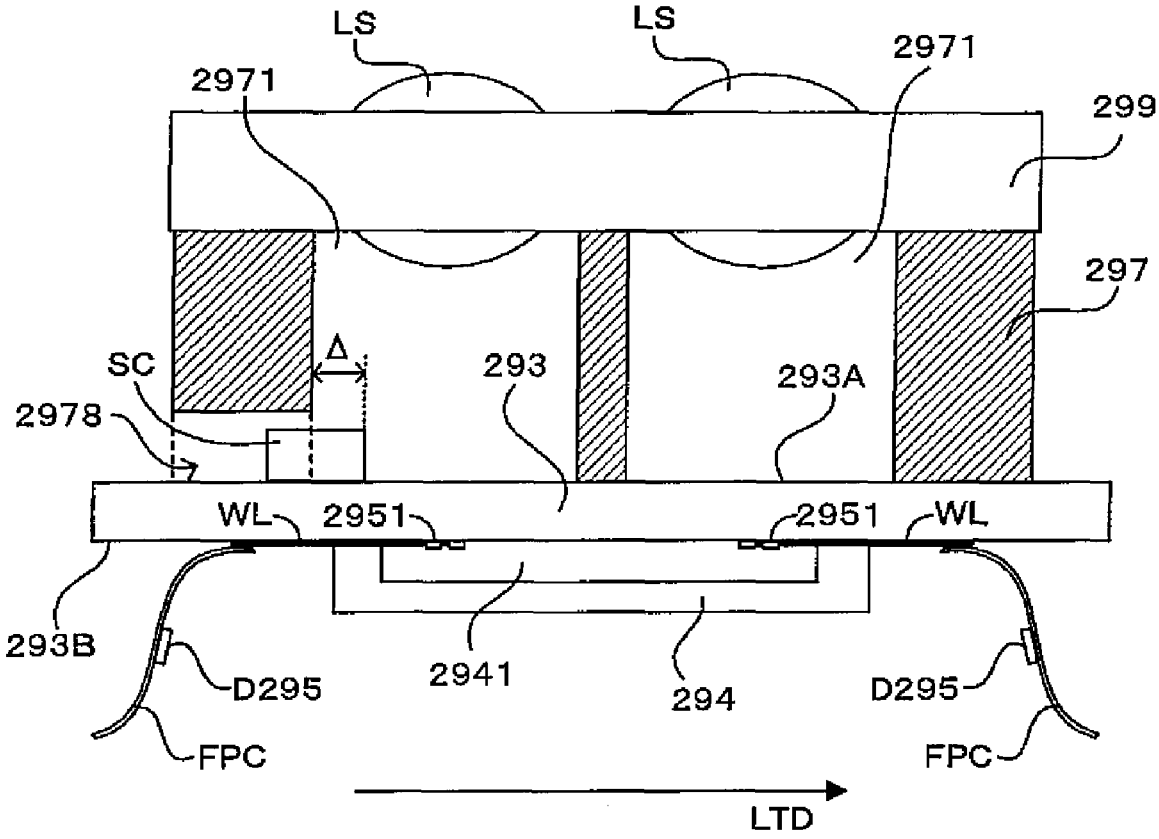
FIG. 27 is a partial sectional view showing another modification of the arrangement mode of flexible printed circuit boards.

In the case of a large circuit scale, the flexible printed circuit board may be arranged as shown in FIG. 27. FIG. 27 is a partial sectional view showing another modification of the arrangement mode of flexible printed circuit boards FPC. As shown in FIG. 27, the wiring WL connected with the light emitting elements 2951 are drawn to the opposite sides in the width direction LTD. At the opposite sides of the head substrate 293 in the width direction LTD, the flexible printed circuit boards FPC are mounted. At each of the opposite ends of the head substrate 293, the drawn out wiring WL and the flexible printed circuit board FPC are connected. The driving circuits D295 are mounted on each flexible printed circuit board FPC and drive signals from the driving circuits D295 can be fed to the light emitting elements 2951. In such a construction, it does not matter at which side in the width direction LTD the optical sensors SC are arranged. However, in the case of arranging the respective optical sensors SC only at one side, the wiring connected with the optical sensors SC can be collectively arranged at the one side. As a result, the wiring can be simplified.

In the construction shown in FIG. 27 or FIG. 4 (hereinafter, FIG. 27 and the like), the light emitting elements 2951, which are organic EL devices, are sealed by a sealing member 294 (sealing glass) made of glass or the like. Such a sealing member 294 is provided for the following purpose. Specifically, an alkaline earth metal such as Ca (calcium) or Ba (barium) is used as a cathode material for organic EL devices in some cases. Such a material quickly deteriorates in the presence of moisture and oxygen. Accordingly, in order to shut off the light emitting elements 2951 from external air, the sealing member 294 is provided. Specifically, the sealing member 294 is mounted on the head substrate under surface 293B after the light emitting elements 2951, driving elements for driving the light emitting elements 2951 and the wiring WL are formed and mounted on the head substrate under surface 293B.

In the construction shown in FIG. 27 and the like, the sealing member 294 has a recess shape with an open upper side in FIG. 27 and a cavity 2941 (hollow space) is formed between the sealing member 294 and the head substrate under surface 293B with the sealing member 294 mounted on the head substrate under surface 293B. An absorbent is provided in this cavity 2941, and moisture in the cavity 2941 is absorbed by this absorbent. In this way, the deterioration of the light emitting elements 2951 caused by moisture is suppressed. Since the sealing member 294 is mounted in a nitrogen atmosphere, an amount of oxygen in the cavity 2941 is also suppressed.

As described above, in the construction using the organic EL devices as the light emitting elements 2951, the sealing member 294 for sealing the light emitting elements 2951 are mounted on the head substrate under surface 293B in addition to the light emitting elements 2951. At this time, the optical sensors SC cannot be mounted on the outer wall surface or the inner wall surface (that is, in the cavity) of the sealing member 294. Accordingly, in the case of trying to arrange the optical sensors SC on the head substrate under surface 293B, the optical sensors SC need to be arranged while avoiding the sealing member 294 and, hence, it is difficult to arranged the optical sensors SC close to the light emitting elements 2951. On the contrary, in the above embodiments, the optical sensors SC are arranged on the head substrate top surface 293A (that is, surface where the light emitting elements 2951 are not formed). Thus, the optical sensors SC can be relatively easily arranged close to the light emitting elements 2951, as shown in FIG. 27 for example, with the result that high-accuracy light quantity detection is possible. In other words, the construction of arranging the optical sensors SC on the head substrate top surface 293A is quite preferable for the line head using organic EL devices as the light emitting elements 2951.

In the above embodiments, the sealing glass forming the cavity 2941 is used as the sealing member 294. However, a sealing structure for sealing the light emitting elements 2951 is not limited to this. For example, a flat sealing glass may be bonded to the entire surfaces of the light emitting elements 2951. Alternatively, a thin film having barrier properties against moisture and oxygen may be formed on the outer surfaces of the light emitting elements 2951 without using the sealing glass. Regardless of which one of the above structures is employed as the sealing structure, the optical sensors SC are arranged on the head substrate top surface 293A in the embodiments of the invention. Thus, the optical sensors SC can be arranged at ideal positions independently of the type of the sealing structure, and hence, high-accuracy light quantity detection is possible.

Although eight light emitting elements 2951 are arranged in an offset manner in each light emitting element group 295 in the above embodiments, the number and arrangement mode of the light emitting elements 2951 are not limited to this.

Figure 28:
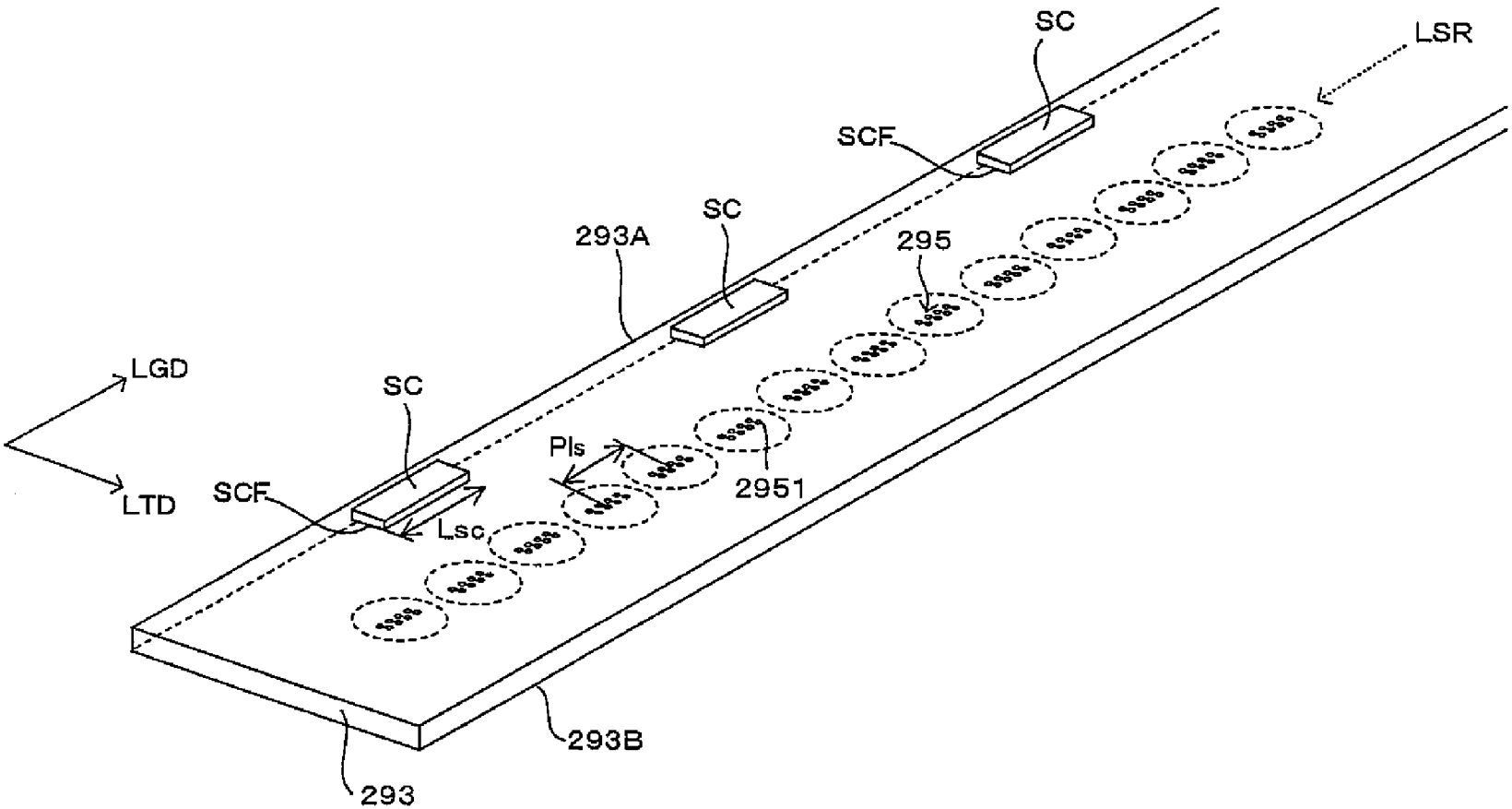
FIG. 28 is a perspective view showing a construction in which the number of the lens row is one.

Although three lens rows LSR are arranged in the width direction LTD in the above embodiments, the number of the lens rows is not limited to three. Specifically, as shown in FIG. 28, the number of the lens row LSR may be one. Here, FIG. 28 is a perspective view showing a construction in which the number of the lens row is one. In FIG. 28, broken line circles PJ are the projections of the lenses LS on the head substrate top surface 293A in the optical axis direction. In the example shown in FIG. 28 as well, the plurality of optical sensors SC are arranged on the top surface 293A of the head substrate 293. The respective optical sensors SC are arranged at one side in the width direction LTD with respect to the plurality of light emitting elements 2951 and are arranged at specified pitches in the longitudinal direction LGD.

The light receiving surfaces SCF of the plurality of optical sensors SC face the head substrate top surface 293A and are bonded to the head substrate top surface 293A with a clear optical adhesive. The light receiving surfaces SCF of the optical sensors SC have the sensor length Lsc in the longitudinal direction LGD (that is, major axis direction of the head substrate 293). The sensor length Lsc is set longer than the pitch Lls between two lenses LS adjacent in the longitudinal direction LGD in each lens row LSR. Accordingly, as described above, a variation in the distance to the light receiving surface SCF between the two light emitting element groups 295 can be suppressed and good light beam detection is realized.

Figure 29:
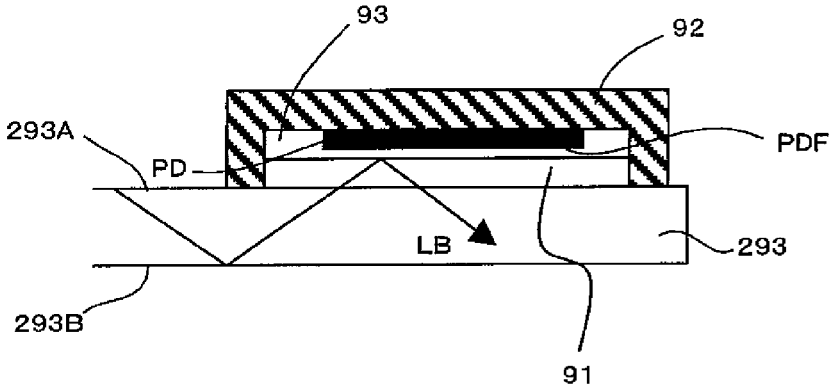
FIG. 29 is a partial sectional view showing a modification of a mounting arrangement of the optical sensor.

A mounting arrangement of the optical sensors SC on the head substrate 293 can be variously modified. FIG. 29 is a partial sectional view showing a modification of a mounting arrangement of the optical sensor. In the modification of FIG. 29, photodiodes PD as the optical sensors SC are accommodated in a package 92. A metal CAN package or a ceramic package widely used for the mounting of the photodiodes PD can be used as this package 92. The package 92 has a recess shape with an open lower side in FIG. 29. An opening of the package 92 is closed by a glass window 91, and a surface of this glass window 91 is held in close contact with the head substrate top surface 293A.

The photodiodes PD are arranged in an air layer 93 between the glass window 91 and the package 92. Light receiving surfaces PDF (light receiving regions) of the photodiodes PD face the head substrate top surface 293A so as to be able to receive light beams incident through the glass window 91 from the head substrate top surface 293A.

In the construction shown in FIG. 29, air is present between the glass window 91 and the photodiodes PD. Accordingly, as shown by an arrow LB in FIG. 29, some of light beams emerging from the head substrate top surface 293A are reflected by the surface of the glass window 91. Thus, in light of increasing the light quantities detected by the photodiodes PD, there is room for improvement. Accordingly, the following construction may be adopted.

Figure 30:
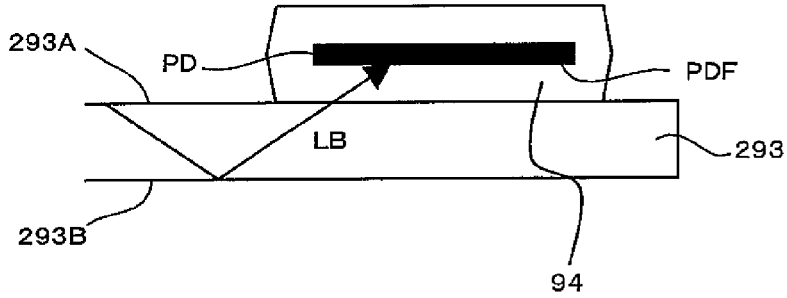
FIG. 30 is a partial sectional view showing another modification of a mounting arrangement of the optical sensor.

FIG. 30 is a partial sectional view showing another modification of a mounting arrangement of the optical sensor. In the modification shown in FIG. 30, the photodiodes PD as the optical sensors SC are sealed in a molded clear resin (resin mold 94). The resin mold 94 is mounted on the head substrate top surface 293A, and the light receiving surfaces PDF (light receiving regions) of the photodiodes PD face the head substrate top surface 293A. In such a construction, a clearance between the photodiodes PD and the head substrate top surface 293A is filled with the clear resin. Accordingly, no interface is present between the photodiodes PD and the resin mold 94 or between the resin mold 94 and the head substrate top surface 293A. Thus, a reduction in the received light quantity caused by the reflection of the light beams as described above is suppressed, and hence, high-accuracy light quantity detection is possible.

Figure 31:
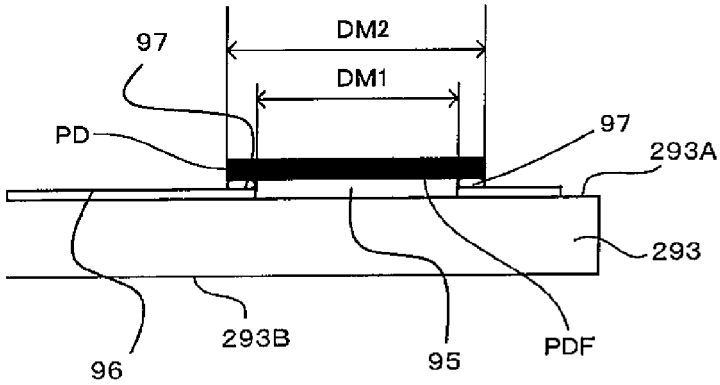
FIG. 31 is a partial sectional view showing still another modification of a mounting arrangement of the optical sensor

FIG. 31 is a partial sectional view showing still another modification of a mounting arrangement of the optical sensor. In the modification shown in FIG. 31, the photodiodes PD as the optical sensors SC are bare-chip mounted on a wiring pattern 96 formed on the top surface of the head substrate 293. Specifically, in this modification, each photodiode PD is a so-called bare chip. In this bare chip, terminals are provided on a surface flush with or substantially flush with the light receiving surface PDF. The terminals are provided at the opposite ends of the bare chip with the light receiving surface PDF located therebetween.

The respective terminals are connected with bumps 97 on the wiring pattern 96 with the light receiving surface PDF (light receiving region) of the photodiode PD opposed to the head substrate top surface 293A. The terminals and the bumps 97 can be connected by being crimped into connection by a flip-chip mounting method or the like. The bumps 97 can be formed of metal plating, solder balls, gold balls or the like. The gap between the light receiving surface PDF and the head substrate top surface 293A is filled with a clear resin 95 Thus, a reduction in the received light quantity caused by the reflection of the light beams as described above is suppressed, and hence, high-accuracy light quantity detection is possible.

In this modification, the photodiode PD is bare-chip mounted. Accordingly, a mounting area DM2 and a light receiving area DM1 are substantially equal. Thus, it is possible to miniaturize the line head 29 while ensuring sufficient light quantities detected by the photodiodes PD. Here, the light receiving area DM1 is the area of a region where the light beams can be actually received in the light receiving surface PDF of the photodiode PD.

In FIGS. 19 and 23 (hereinafter, FIG. 19 and the like), the optical sensors SC are so arranged as to partly overlap the light guide holes 2971. At this time, one end portion of each optical sensor SC is arranged in the sensor arrangement space 2978 (second space). This sensor arrangement space 2978 is formed to penetrate the light shielding member 297 in the width direction LTD. However, the sensor arrangement space 2978 may be formed as follows.

Figure 32:
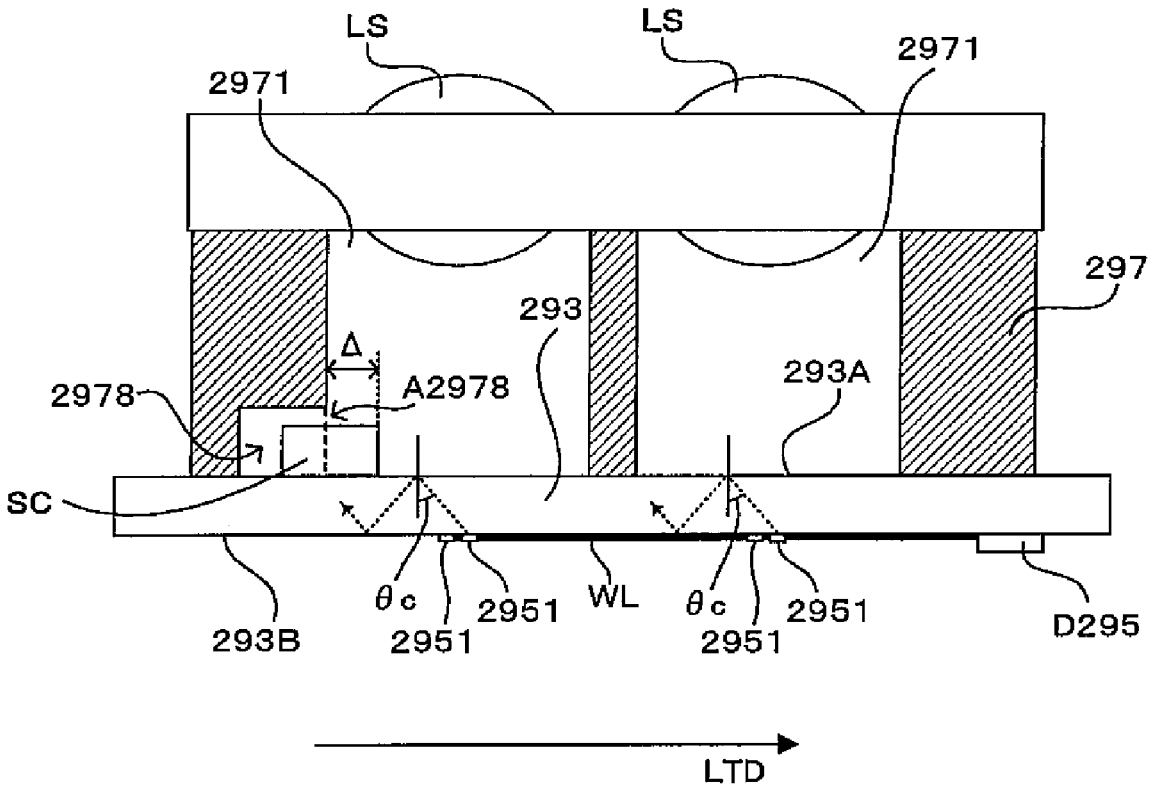
FIG. 32 is a partial sectional view showing a modification of the sensor arrangement space.

FIG. 32 is a partial sectional view showing a modification of the sensor arrangement space. A part of the light shielding member 297 facing the head substrate 293 is cut out to form the sensor arrangement space 2978. The construction of FIG. 32 and that of FIG. 19 and the like are common in that the sensor arrangement space 2978 has an opening toward the light guide holes 2971. However, the sensor arrangement space 2978 of FIG. 32 does not penetrate in the width direction LTD and a side thereof opposite to an opening A2978 in the width direction LTD is closed. The sensor arrangement space 2978 of FIG. 32 and that of FIG. 19 and the like differ in such a point. In this modification as well, the optical sensors SC can be arranged to overlap the light guide holes 2971 only by the overlapping width Δ. Accordingly, the optical sensors SC can be arranged closer to the light emitting elements 2951, whereby the light quantities detected by the optical sensors SC can be increased. As a result, the light quantities can be detected with high detection accuracy by the optical sensors SC.

As described above, an embodiment of a line head, comprises: a substrate which is transmissive and includes a first surface and a second surface facing the first surface; a plurality of light emitting elements which are arranged on the first surface of the substrate and emit light beams; a wiring which is arranged on the first surface of the substrate and is connected with the plurality of light emitting elements; a lens array that includes a plurality of imaging lenses which are arranged facing the light emitting elements at a side of the second surface of the substrate and focus the light beams emitted from the facing light emitting elements to form spots; and an optical sensor which detects the light beams emitted from the light emitting elements and is arranged on the second surface of the substrate.

Further, as described above, an embodiment of an image forming apparatus, comprises: a latent image carrier; and a line head that includes a substrate which is transmissive and has a first surface and a second surface facing the first surface, a plurality of light emitting elements which are arranged on the first surface of the substrate and emit light beams, a wiring which is arranged on the first surface of the substrate and is connected with the plurality of light emitting elements, a lens array that has a plurality of imaging lenses which are arranged facing the light emitting elements at a side of the second surface of the substrate and focus the light beams emitted from the facing light emitting elements to form spots on a surface of the latent image carrier, and an optical sensor which detects the light beams emitted from the light emitting elements and is arranged on the second surface of the substrate.

The embodiment constructed as above comprises the substrate having the first surface and the second surface facing the first surface and transmitting light, and the plurality of light emitting elements arranged on the first surface of the substrate. Accordingly, light beams emitted from the light emitting elements propagate in the substrate from the first surface to the second surface of the substrate. The imaging lenses are arranged to face the light emitting elements at the second surface side of the substrate. Therefore, the light beams emitted from the light emitting elements and emerging from the second surface are imaged by the imaging lenses arranged to face the light emitting elements.

As described above, in this embodiment, the light beam emitted from the light emitting element is imaged by one imaging lens facing this light emitting element to form a spot. In this respect, this embodiment differs from the related art in which a light beam emitted from one light emitting element is superimposed by a plurality of refractive index distribution type lenses to form a spot. Accordingly, in this embodiment, the occurrence of a problem that an image is split to blur a spot due to the deviation of the relative positions of the light emitting element and the imaging lenses is suppressed and good exposure is possible. Since light beams are imaged without using refractive index distribution type lenses having large optical aberrations in this embodiment, it is possible to form fine spots and realize better exposure as compared with the related art.

Further, this embodiment comprises the optical sensor arranged on the second surface of the substrate. Accordingly, the embodiment can detect a light quantity variation among the plurality of light emitting elements by detecting the light beams emitted from the respective light emitting elements using the optical sensor and is advantageous in realizing good exposure. The embodiment can also suppress a problem which could occur upon arranging the optical sensor in the above construction. This point is described.

The plurality of light emitting elements and the wiring connected with the light emitting elements are arranged on the first surface of the substrate. Accordingly, in the case of arranging the optical sensor on the first surface of the substrate, a problem that the light emitting elements or the wiring interfere with the optical sensor could occur. As a countermeasure, the optical sensor is arranged on the second surface of the substrate in this embodiment. Thus, this embodiment is advantageous in being able to realize good exposure by detecting a light quantity variation among the plurality of light emitting elements while suppressing the problem that the optical sensor interferes with the other members (light emitting elements, wiring).

The imaging lenses may be constructed as follows in the line head for focusing light beams toward an image plane. Specifically, the optical sensor may be arranged at one side in a minor axis direction of the substrate with respect to the plurality of light emitting elements. By arranging the optical sensor at the one side in the minor axis direction with respect to the light emitting elements in this way, distances from the light emitting elements to the optical sensor can be relatively shortened to increase the quantity of lights reaching the optical sensor. As a result, light beam detection accuracy is improved and good exposure can be realized.

A plurality of optical sensors may be arranged at the one side in the minor axis direction with respect to the plurality of light emitting elements. In the case of such a construction, light beams from the light emitting elements can be detected by the plurality of optical sensors to improve the light beam detection accuracy. Since these plurality of optical sensors are arranged at the one side in the minor axis direction in such a construction, the wiring leading to the optical sensors can be simplified, which is advantageous.

A plurality of light emitting element groups each as a group of a plurality of light emitting elements may be arranged on the substrate, and the imaging lenses may be arranged to face the light emitting element groups in a one-to-one correspondence in the lens array. Since lights from the plurality of light emitting elements are imaged by one imaging lens in such a construction, the aperture of the imaging lens becomes larger. As a result, more lights can be incident on the imaging lenses and satisfactory spot formation is possible.

In the line head including such light emitting element groups, the plurality of imaging lenses may be arranged in a major axis direction of the substrate to form a lens row in the lens array. Further, in the lens array, a plurality of lens rows may be arranged at mutually different positions in the minor axis direction. In the construction with such lens rows, the light receiving region of the optical sensor may be arranged to face the second surface of the substrate and the length of the light receiving region in the major axis direction may be set longer than a pitch between two imaging lenses adjacent in the major axis direction in the lens row. The reason for this is described.

In this line head, the light emitting element groups are arranged to face the respective imaging lenses. As a result, in the construction with the above lens row, the light emitting element groups are also arranged in the major axis direction. Light beams from the respective light emitting element groups arranged in the major axis direction are incident on the light receiving region of the optical sensor. Accordingly, if the length of the light receiving region in the major axis direction is shorter than the pitch between two light emitting element groups arranged in the major axis direction (that is, pitch between two imaging lenses adjacent in the major axis direction), distances to the light receiving region vary between these two light emitting element groups. As a result, there has been a possibility that the optical sensor cannot detect the light beams. On the contrary, in the case of the construction in which the length of the light receiving region in the major axis direction is longer than the pitch between two imaging lenses adjacent in the major axis direction in the lens row, the above variation in the distance to the light receiving region between the two light emitting element groups can be suppressed, with the result that satisfactory light beam detection can be realized.

The light beams emitted from the light emitting elements reach the optical sensor after propagating in the substrate while being repeatedly reflected between the first surface and the second surface of the substrate. On the other hand, the wiring is arranged on the first surface of the substrate as described above. As a result, there are cases where the reflection of the light beams propagating from the light emitting elements toward the optical sensor is disturbed by the wiring on the first surface of the substrate to reduce the quantity of the light beams reaching the optical sensor. Accordingly, a reflection film may be arranged between the wiring arranged in an area of the first surface of the substrate extending from the light emitting elements toward the optical sensor and the first surface. This is because light beams can reach the optical sensor without the reflection thereof at the first surface being disturbed by providing the reflection film on the first surface.

An electronic component may be arranged in an area of the first surface of the substrate at a side opposite to the optical sensor with respect to the plurality of light emitting elements in the minor axis direction and the wiring may be connected with the electronic component. Since the electronic component is arranged at the side opposite to the optical sensor in such a construction, the interference of the electronic component and the optical sensor can be suppressed.

The first and second surfaces of the substrate may be parallel. Such a construction can efficiently introduce light beams from the light emitting elements to the optical sensor As a result, more light can be incident on the optical sensor and light beam detection accuracy can be improved.

A light shielding member may be further arranged between the substrate and the lens array and may be provided with light guide holes penetrating from the light emitting elements toward the imaging lenses facing the light emitting elements. Since crosstalk, in which unnecessary lights are incident on the imaging lenses, can be suppressed in such a construction, satisfactory spot formation is possible.

At this time, the optical sensor may be arranged at an outer side of the light shielding member in the minor axis direction.

Further, a part of the light shielding member facing the substrate may be cut out to form a first space between the light shielding member and the substrate, and the optical sensor may be so arranged in the first space as to overlap the light shielding member in the minor axis direction. By such a construction, the optical sensor can be arranged close to the light emitting elements to increase the light quantity detected by the optical sensor. As a result, the detection accuracy of the optical sensor is improved.

A part of the light shielding member facing the substrate may be cut out to form a second space which open into the light guide holes between the light shielding member and the substrate, and the optical sensor may be so arranged in the second space as to partly project into the light guide hole through an opening of the second space, thereby overlapping the light guide hole. By such a construction, the optical sensor can be arranged closer to the light emitting elements to increase the light quantity detected by the optical sensor. As a result, the optical sensor can detect the light quantity with high detection accuracy.

At this time, a plurality of light guide holes may be communicated with each other via the second space, and the optical sensor may overlap the plurality of light guide holes communicated with each other. By such a construction, the optical sensor can detect the light quantity with higher detection accuracy.

The light receiving region of the optical sensor may be arranged to face the second surface of the substrate and bonded to the second surface of the substrate with an optical adhesive. An interface between the second surface of the substrate and the optical sensor is eliminated by such bonding with the optical adhesive to suppress the reflection of light beams between the second surface of the substrate and the optical sensor. As a result, the quantity of lights incident on the optical sensor can be increased.

The light receiving region of the optical sensor may be arranged to face the second surface of the substrate, and a space between the light receiving region and the second surface of the substrate may be filled with a clear resin. The reflection of light beams between the second surface of the substrate and the optical sensor can also be suppressed by adopting such a construction. As a result, the quantity of lights incident on the optical sensor can be increased.

The optical sensor may be bare-chip mounted. This can make the mounting area of the optical sensor smaller, and the line head can be miniaturized while a sufficient receiving light quantity is ensured for the optical sensor.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A line head, comprising:

a substrate which is transmissive and includes a first surface and a second surface facing the first surface;

a plurality of light emitting elements which are arranged on the first surface of the substrate and emit light beams;

a wiring which is arranged on the first surface of the substrate and is connected with the plurality of light emitting elements;

a lens array that includes a plurality of imaging lenses which are arranged at a side of the second surface of the substrate, face the light emitting elements, and focus the light beams emitted from the facing light emitting elements to form spots;

an optical sensor which detects the light beams emitted from the light emitting elements and is arranged on the second surface of the substrate; and a reflection film which is arranged between the first surface of the substrate and the wiring arranged in an area of the first surface extending from the light emitting elements toward the optical sensor.

2. A line head comprising:

a substrate which is transmissive and includes a first surface and a second surface facing the first surface;

a plurality of light emitting elements which are arranged on the first surface of the substrate and emit light beams;

a wiring which is arranged on the first surface of the substrate and is connected with the plurality of light emitting elements;

a lens array that includes a plurality of imaging lenses which are arranged at a side of the second surface of the substrate, face the light emitting elements, and focus the light beams emitted from the facing light emitting elements to form spots; and an optical sensor which detects the light beams emitted from the light emitting elements and is arranged on the second surface of the substrate, wherein the optical sensor is so arranged that a light receiving region of the optical sensor faces the second surface of the substrate, and a space between the light receiving region of the optical sensor and the second surface of the substrate is filled with a clear resin.

3. The line head according to claim 2, wherein the optical sensor is bare-chip mounted to the second surface of the substrate.

4. A line head, comprising:

a substrate which is transmissive and includes a first surface and a second surface facing the first surface;

a plurality of light emitting elements which are arranged on the first surface of the substrate and emit light beams;

a wiring which is arranged on the first surface of the substrate and is connected with the plurality of light emitting elements;

a lens array that includes a plurality of imaging lenses which are arranged at a side of the second surface of the substrate, face the light emitting elements, and focus the light beams emitted from the facing light emitting elements toward an image plane to form spots;

an optical sensor which detects the light beams emitted from the light emitting elements and is arranged on the second surface of the substrate at one side in a minor axis direction of the substrate with respect to the plurality of light emitting elements; and an electronic component which is arranged in an area of the first surface of the substrate at a side opposite to the optical sensor with respect to the plurality of light emitting elements in the minor axis direction and with which the wiring is connected.

* * * * *